US005585584A

United States Patent [19]

Usa

[11] Patent Number: 5,585,584

[45] Date of Patent: Dec. 17, 1996

[54] AUTOMATIC PERFORMANCE CONTROL APPARATUS

[75] Inventor: Satoshi Usa, Hamamatsu, Japan

[73] Assignee: Yamaha Corporation, Japan

[21] Appl. No.: 643,851

[22] Filed: May 6, 1996

[30] Foreign Application Priority Data

May 9, 1995 [JP] Japan ..... 7-110549

[51] Int. Cl.[6] ..... G10H 4/00

[52] U.S. Cl. ..... 84/600; 84/636; 84/652; 84/668; 84/662; 84/723

[58] Field of Search ..... 84/609–612, 626, 84/634–636, 645, 649–652, 662, 666–668, 723–725, DIG. 24, 600

[56] References Cited

U.S. PATENT DOCUMENTS

| | | | |
|---|---|---|---|
| 4,341,140 | 7/1982 | Ishida . | |
| 5,170,002 | 12/1992 | Suzuki et al. | 84/600 |
| 5,290,964 | 3/1994 | Hiyoshi et al. | 84/600 |
| 5,313,100 | 5/1994 | Matsushima et al. | 84/600 |
| 5,338,891 | 8/1994 | Masubuchi et al. | 84/600 |
| 5,350,881 | 9/1994 | Kashio et al. | 84/622 |

*Primary Examiner*—William M. Shoop, Jr.
*Assistant Examiner*—Marlon Fletcher
*Attorney, Agent, or Firm*—Graham & James LLP

[57] ABSTRACT

An automatic performance control apparatus provides a hand controller which contains gyro sensors in X, Y directions. The gyro sensors are employed to accurately detect hand-swing motion applied to the hand controller without being affected by gravity. When the hand controller is swung by a human operator like a conductor's baton, angular velocity applied to the hand controller is detected based on detection values of the gyro sensors. The angular velocity becomes bottom at a change point of direction in a locus of the hand-swing motion of the hand controller; and a peak of the angular velocity appears between bottoms. So, peak detection process is performed on the angular velocity to determine a beat timing designated by the human operator. If the peak is detected, beat-timing detection data are automatically created and are transmitted to an electronic musical instrument having an automatic performance function. Based on the beat-timing detection data, the electronic musical instrument performs tempo control during progression of automatic performance in real time. Moreover, beat-number determination process is performed to make a decision as to which of beats in triple time corresponds to a current peak of the angular velocity. The tempo control of the automatic performance responds to a beat number determined, thus avoiding a deviation between beats of the automatic performance and beats designated by he human operator. Incidentally, it is possible to further provide acceleration sensors which cooperate with the gyro sensors to assist the peak detection.

35 Claims, 15 Drawing Sheets

BEAT-TIMING DETECTION DATA
INTERVAL
FAST FEED

CORRECTED DELTA TIME
DELTA-ACM
KON_RCV← 1
CORRECTING BY T_COEF

PERFORMANCE DATA

BEAT-TIMING DETECTION DATA
INTERVAL
PAUSE

CORRECTED DELTA TIME
DELTA-ACM
CORRECTING BY T_COEF

PERFORMANCE DATA

AUTOMATIC PERFORMANCE CONTROL APPARATUS

BACKGROUND OF THE INVENTION

1. Field of the Invention

The invention relates to automatic performance control apparatuses which control a tempo of automatic performance in accordance with an action of a human operator such as a conductor.

2. Prior Art

Conventionally, there are provided a variety of apparatuses which control a tempo of automatic performance in real time. One type of the apparatus is known as a tapping device in which a push-button switch is turned ON responsive to a beat timing so that a tempo (i.e., beat timings) of the automatic performance is controlled in accordance with ON timing of the push-button switch. Another type of the apparatus is designed in such a way that a swing state of an object, manipulated by a human operator, is detected so as o control a tempo of the automatic performance in response to the swing state detected.

As a sensor which detects the swing state of the object described above, an acceleration sensor is generally employed. Other than the acceleration sensor, it is possible to employ a strain gauge which is attached to a conductor's baton. Herein, the strain gauge measures strain which occurs due to a swing motion of the baton, so that the swing motion is detected by the strain gauge.

The aforementioned apparatuses conventionally known suffer from problems, as follows:

The tapping device is designed to control a tempo of the automatic performance based on simple switching actions by which the push-button switch is repeatedly turned ON. However, those actions are monotonous and are far from conducting actions of the music. If the acceleration sensor is used to conduct a tune having a slow tempo, actions imparted to the acceleration sensor should be small. This causes a small variation of acceleration. Range of such a small variation of acceleration overlaps with a certain frequency range corresponding to a variation of acceleration detected by the acceleration sensor which is unintentionally swung due to an effect of gravity. For this reason, it is impossible to provide separation between those ranges. In short, it is impossible to detect a slow tempo in a stable manner. Further, even if the strain gauge is attached to the conductor's baton, fundamental function of the strain gauge is similar to that of the acceleration sensor. So, as similar to the case of the acceleration sensor, the strain gauge cannot detect slow acceleration and slow deceleration as well as uniform motion applied to the baton.

The conventional apparatuses are fundamentally designed to control a tempo of the automatic performance by designating beat timings. So, there is a possibility that some cause produce a deviation between an action of a performer and a beat timing of performance. For example, although the performer intends to make a swing action with respect to a second beat in certain time, the performance may be mistakenly made with respect to a first beat. If such a deviation occurs, it is difficult to restore such a deviated state to an original state of the performance.

SUMMARY OF THE INVENTION

It is an object of the invention to provide an automatic performance control apparatus which is capable of controlling automatic performance in accordance with an action of a human operator without causing a deviation between the action and a beat timing of automatic performance.

An automatic performance control apparatus of the invention provides a hand controller which contains gyro sensors in X, Y directions. The gyro sensors are employed to accurately detect hand-swing motion applied to the hand controller without being affected by gravity. When the hand controller is swung by a human operator like a conductor's baton, angular velocity applied to the hand controller is detected based on detection values of the gyro sensors. The angular velocity becomes bottom at a change point of direction in a locus of the hand-swing motion of the hand controller; and a peak of the angular velocity appears between bottoms. So, peak detection process is performed on the angular velocity to determine a beat timing which is designated by the human operator for triple time, for example.

If the peak is detected, beat-timing detection data are automatically created and are transmitted to an electronic musical instrument having an automatic performance function. Based on the beat-timing detection data, the electronic musical instrument performs tempo control during progression of automatic performance in real time.

Moreover, beat-number determination process is performed to make a decision as to which of beats in triple time corresponds to a current peak of the angular velocity. The tempo control of the automatic performance responds to a beat number determined, thus avoiding a deviation between beats of the automatic performance and beats designated by the human operator.

Incidentally, it is possible to further provide acceleration sensors which cooperate with the gyro sensors to assist the peak detection.

BRIEF DESCRIPTION OF THE DRAWINGS

These and other objects of the subject invention will become more fully apparent as the following description is read in light of the attached drawings wherein.

DESCRIPTION OF THE PREFERRED EMBODIMENT

Now, an automatic performance control device, which is designed in accordance with an embodiment of the invention, will be described in conjunction with the drawings, wherein parts equivalent to those of some drawings will be designated by-the same numerals; hence, the description thereof will be omitted according to needs.

Figure 1A:
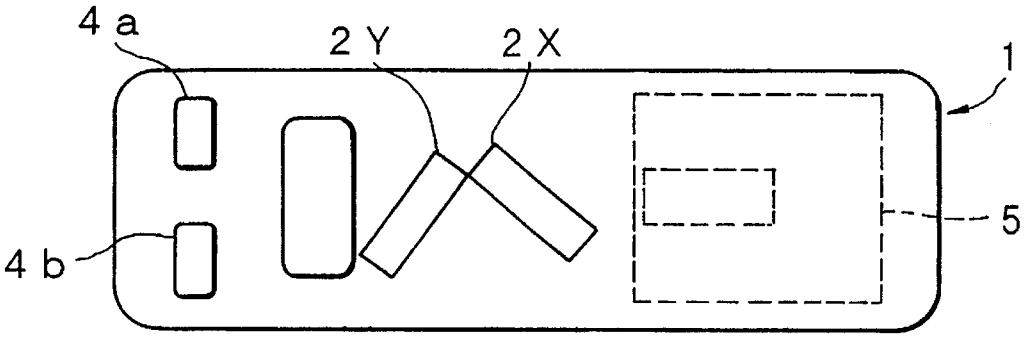
FIG. 1A is a cross-sectional view which is take from a plan view of a hand controller.
Figure 1D:
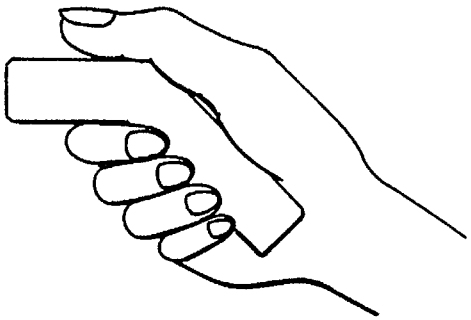
FIG. 1D is a view showing the hand controller which is grasped by a hand of a human operator.
Figure 1B:
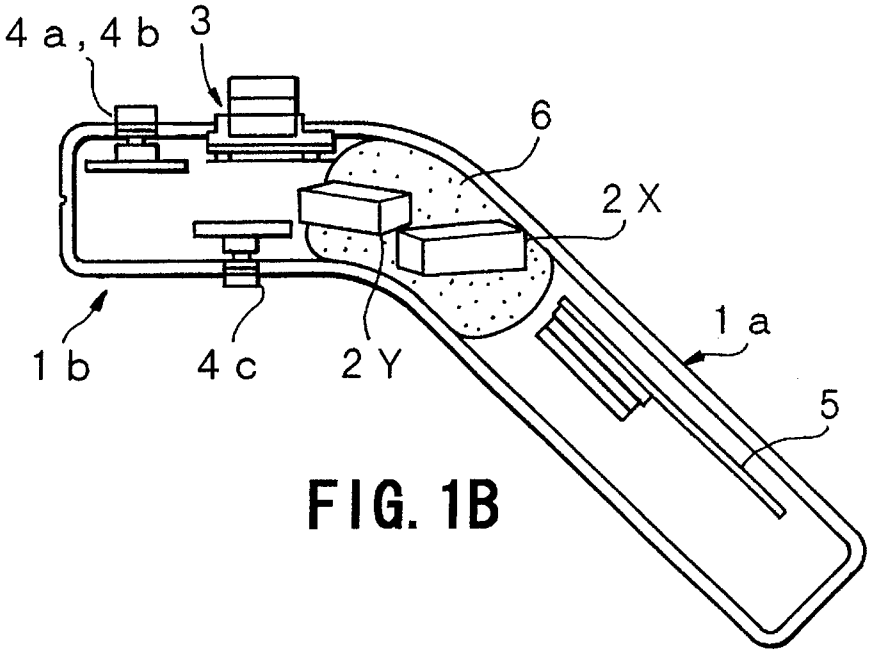
FIG. 1B is a cross-sectional view which is taken from a side view of the hand controller.
Figure 1C:
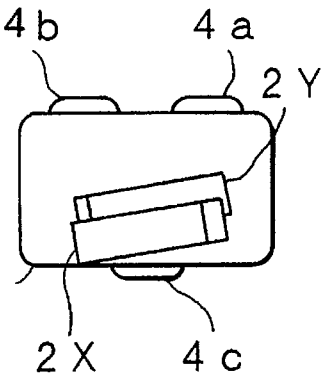
FIG. 1C is a cross-sectional view which is taken from a front view of the hand controller.

FIGS. 1A, 1B, 1C and 1D are provided to illustrate a hand controller 1, in different views, which is used by the automatic performance control apparatus. Herein, FIGS. 1A, 1B and 1C provide a triangular view of an illustration of the hand controller 1; and FIG. 1D shows a manner of manipulation of the hand controller 1. A human operator (i.e., a performer) swings the hand controller 1 in a desired direction like a conductor's baton while conducting automatic performance by an electronic musical instrument EI having an automatic performance function. Thus, it is possible to control a tempo or dynamics (e.g., tone volume) of the automatic performance.

The hand controller 1 has a square-pole like shape, a middle part of which is bent by 30° or so. A bent portion of the hand controller 1 is used as a boundary, by which the hand controller 1 is divided into two sections, i.e., a grip section 1*a* and a manipulation section 1*b*. Each angle and each side of the hand controller 1 are subjected to chamfering in order that the hand controller 1 as a whole can be easily grasped by a hand of the performer. A finger pressure sensor 3 and control key switches 4*a*, 4*b* are attached to an upper face of the manipulation section 1*b*. In addition, a control key switch 4*c* is attached to a lower face of the manipulation section 1*b*. The performer grasps the grip section 1*a* of the hand controller 1 by his hand in such a manner, as shown by FIG. 1D, that a thumb is placed on the upper face of the manipulation section 1*b*. So, the performer conducts musical performance by swinging the hand controller 1 like a conductor's baton. Further, the finger pressure sensor 3 and/or the control key switches 4*a*, 4*b* are manipulated by the thumb of the performer whilst the control key switch 4*c* is manipulated by a forefinger of the performer. Those switches are manipulated according to needs.

At an inside of the hand controller 1, there are provided two gyro sensors 2X and 2Y as well as an electric circuit board 5. The electric circuit board 5 provides transmission of signals which represent detection values of the gyro sensors 2X, 2Y, content of manipulation of the finger pressure sensor 3 and contents of manipulation of the control key switches 4*a* to 4*c*. Those signals are transmitted to a main body of the automatic performance control apparatus. The gyro sensors 2X and 2Y are built In the bent portion of the hand controller 1. Herein, the gyro sensor 2X is arranged in a direction formed between a left-front position and a right-back position whilst the gyro sensor 2Y is arranged in a direction formed between a right-front position and a left-back position. The gyro sensors 2X and 2Y are connected to the electric circuit board 5 by lead wires (not shown). In addition, the gyro sensors 2X and 2Y are supported by being surrounded by a support member 6 such as urethane rubber. The support member 6 can be made using some materials other than the urethane rubber. For example, it is possible to use sponge and foaming styrene resin.

The embodiment uses the aforementioned gyro sensors 2X and 2Y on the basis of reasons, as follows:

When the performer swings the hand controller 1 to designate a tempo, complex movement is transmitted to a hand of the performer. Herein, the complex movement corresponds to accumulation in variations of a plenty of angles based on different kinds of actions such as rotation of a joint of shoulder, bending actions and/or twisting actions of a joint of elbow, bending actions and/or twisting actions of a joint of wrist. Even if the performer conducts music of a simple time such as duple time and triple time, the hand controller 1 is subjected to complex movement which contains a swing motion in a slanted direction. So, we have make a study to determine arrangement of two gyro sensors, which can accurately detect such a complex movement, by experiments. Results of the experiments show that the aforementioned arrangement of the gyro sensors 2X and 2Y as shown by FIGS. 1A, 1B and 1C is optimum.

The electric circuit board 5 should be arranged in the grip section 1*a* because the grip section 1*a* provides a largest area within the hand controller 1. So, it is preferable to arrange the electric circuit board 5 along the grip section 1. Due to such an arrangement, the gyro sensors 2X and 2Y are not directly soldered to the electric circuit board 5; but they are connected to the electric circuit board 5 by lead wires.

As described above, the gyro sensors 2X and 2Y are not directly soldered to the electric circuit board 5 and are supported by the support member 6. So, it is possible to set an optimum positions of the gyro sensors 2X and 2Y in the hand controller 1 containing the electric circuit board 5; and it is possible to set optimum directions in arrangement of the gyro sensors 2X and 2Y by which swing movement of the hand controller 1 can be detected with accuracy. Moreover, the support member 6 is made by cushioning material such as urethane rubber. So, it is possible to protect the gyro sensors which are naturally weak in impact.

The aforementioned complex movement of the hand differs by each person. For this reason, the support member 6 is made by cushioning material which has an ability of plastic deformation. So, positions and/or directions in arrangement of the gyro sensors 2X and 2Y can be adjusted in such a way that a user can easily treat the hand controller 1.

Figure 2:
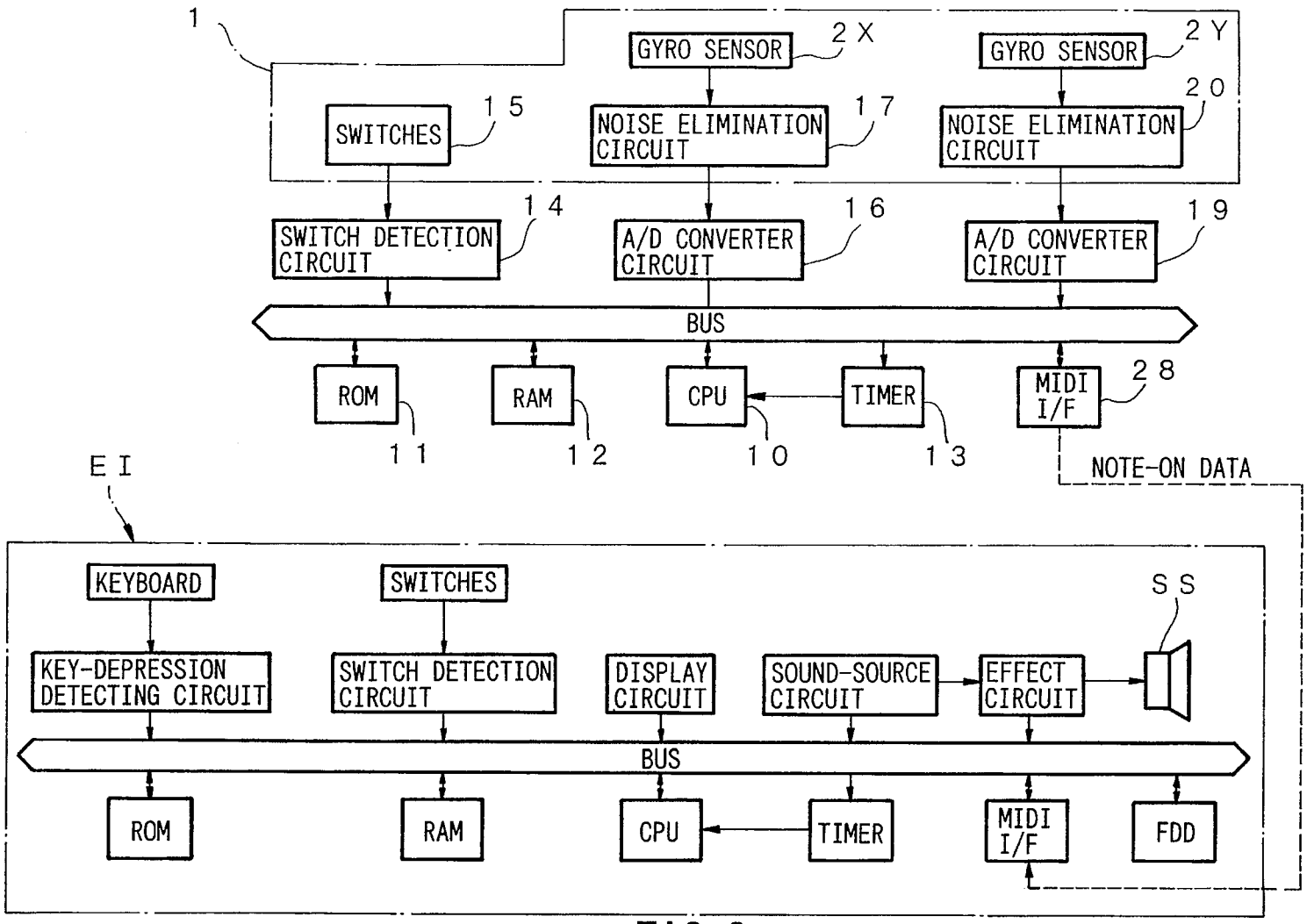
FIG. 2 is a block diagram showing an automatic performance control apparatus, which is designed in accordance with an embodiment of the invention, as well as an electronic musical instrument.

FIG. 2 is a block diagram, an upper section of which shows an electronic configuration of a main body of an automatic performance control apparatus which is designed in accordance with an embodiment of the invention. The hand controller 1 is connected to this automatic performance control apparatus. Herein, a CPU 10 controls an overall operation of the automatic performance control apparatus based on control programs. The CPU 10 performs data communication through a bus which connects with a ROM 11, a RAM 12, a timer 13 and a switch detection circuit 14 as well as A/D converter circuits 16 and 19. The RAM 12 stores data which are produced in response to hand-swing motion of the hand controller 1. The ROM 11 stores the control programs which are used by the CPU 10. The switch detection circuit 14 transmit contents of detection, performed by the finger pressure sensor 3 and control key switches of the hand controller 1, to the CPU 10. As functions of the control key switches, there are provided start/stop functions of automatic performance. A value of detection of the finger pressure sensor 3 is used for controlling of tone volume and controlling of effects such as reverberation effect, for example. The gyro sensors 2X and 2Y, namely "piezoelectric-vibration gyro sensors", are respectively connected with the A/D converter circuits 16 and 19 through noise elimination circuits 17 and 20. The noise elimination circuits 17 and 20 eliminate noise components, such as small vibration components and low-frequency components, from output signals of the gyro sensors 2X and 2Y respectively. In other words, the noise elimination circuits 17 and 20 extract signals which correspond to hand-swing motion of the hand controller. Those signals are supplied to the A/D converter circuits 16 and 19. Output data of the A/D converter circuit 16 are transmitted to the CPU 10 as angular velocity data of X direction. Output data of the A/D converter circuit 19 are transmitted to the CPU 10 as angular velocity data of Y direction. The timer 13 causes interruption for the CPU 10 by each time, which is set at 10 ms or so.

The automatic performance control apparatus of FIG. 2 (simply called the apparatus) detects a beat timing, which is designated by a human operator, based on the angular velocity data of X direction and Y direction, thus creating beat-timing detection data. The beat-timing detection data are outputted to an electronic musical instrument EI having an automatic performance function through a MIDI interface 28 (where 'MIDI' is an abbreviation for 'Musical Interface Digital Interface'). Since the electronic musical instrument EI having the automatic performance function is generally known, a detailed description thereof will be omitted in this specification. Briefly speaking, this electronic musical instrument EI is an apparatus which sequentially read out automatic performance data, stored in memories such as floppy disks or RAMs, in accordance with tempo clocks so that the automatic performance data are sent to a sound source circuit, thus carrying out automatic performance. Data communication for the beat-timing detection data is performed between the automatic performance control apparatus and the electronic musical instrument EI through the MIDI interface 28. This data communication is performed in a data form which corresponds to note-on data assigned to CHANNEL 1 of MIDI. That is, the data communication does not use system exclusive message; in other words, the data communication is performed using 'general' MIDI data (e.g., note-on message). Thus, the automatic performance control apparatus of the present embodiment can perform data communication with any kinds of instruments even if the instruments are manufactured by different manufacturers. The electronic musical instrument EI controls a tempo of automatic performance based on an interval of time between receiving timings of note-on messages.

Figure 3A:
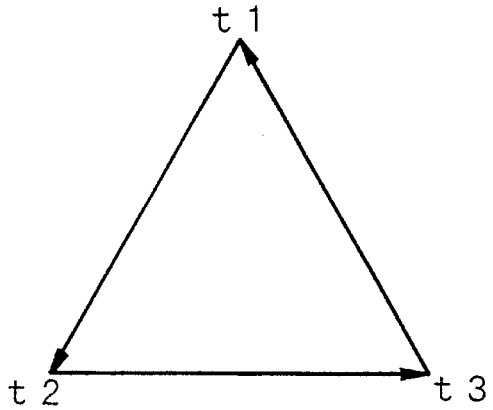
FIG. 3A simply shows a locus of a conductor's baton which is swung by a conductor with respect to triple time.
Figure 3B:
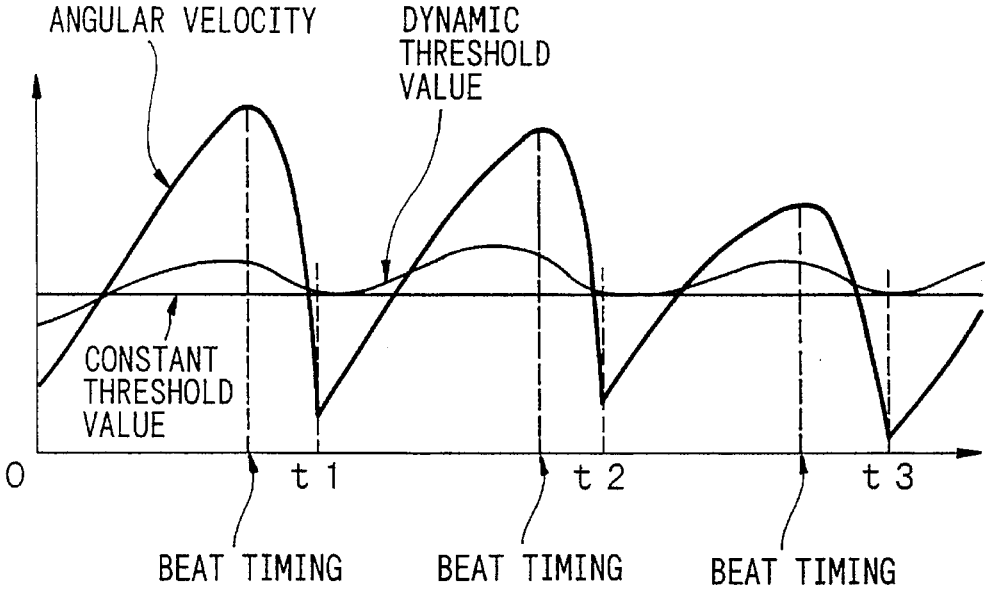
FIG. 3B is a graph showing variation of angular velocity which is applied to the hand controller.
Figure 3C:
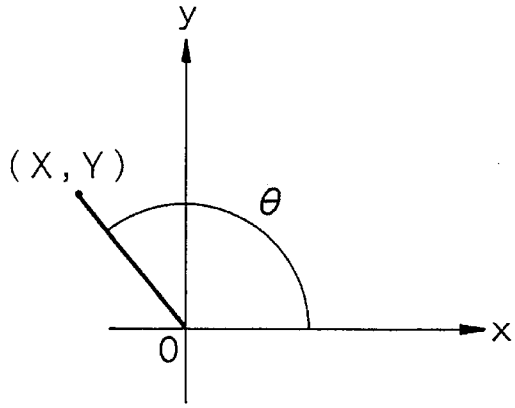
FIG. 3C shows a coordinates system which is used for detection of a beat designated by the hand controller.

FIGS. 3A, 3B and 3C are drawings which are used to explain a method of detection of beats. FIGS. 4 to 8 a flowcharts which show operations of the automatic performance control apparatus, wherein those flowcharts correspond to an example of performance control in a tune of triple time. Now, operation of the automatic performance control apparatus will be explained with reference to those figures.

FIG. 3A shows a simple hand-swing motion of a conductor who conducts a tune of triple time. When conducting the tune of triple time, a locus of a conductor's baton approximately corresponds to an equilateral triangle. So, the human operator swings the hand controller 1 to form a locus of equilateral triangle. An angular velocity corresponding to a hand-swing motion of the hand controller 1 is varied as shown by a graph of FIG. 3B. Just before the hand-swing motion of the hand controller 1 reaches a vertex of the equilateral triangle shown by FIG. 3A, the angular velocity of the hand controller 1 reaches a peak. Then, the angular velocity suddenly falls down to a bottom because a hand-swing direction of the hand controller 1 changes at the vertex of the equilateral triangle. Actually, however, when a human operator manipulates the hand controller 1, it is almost impossible to move the hand controller 1 accurately along the locus of equilateral triangle shown in FIG. 3A. So, variation of angular velocity should correspond to a unnatural curve which is further deformed as compared to a curve of FIG. 3B. The flowcharts, which will be explained below, are designed to perform tempo control by detecting the peak of the angular velocity as a beat timing.

Figure 4:
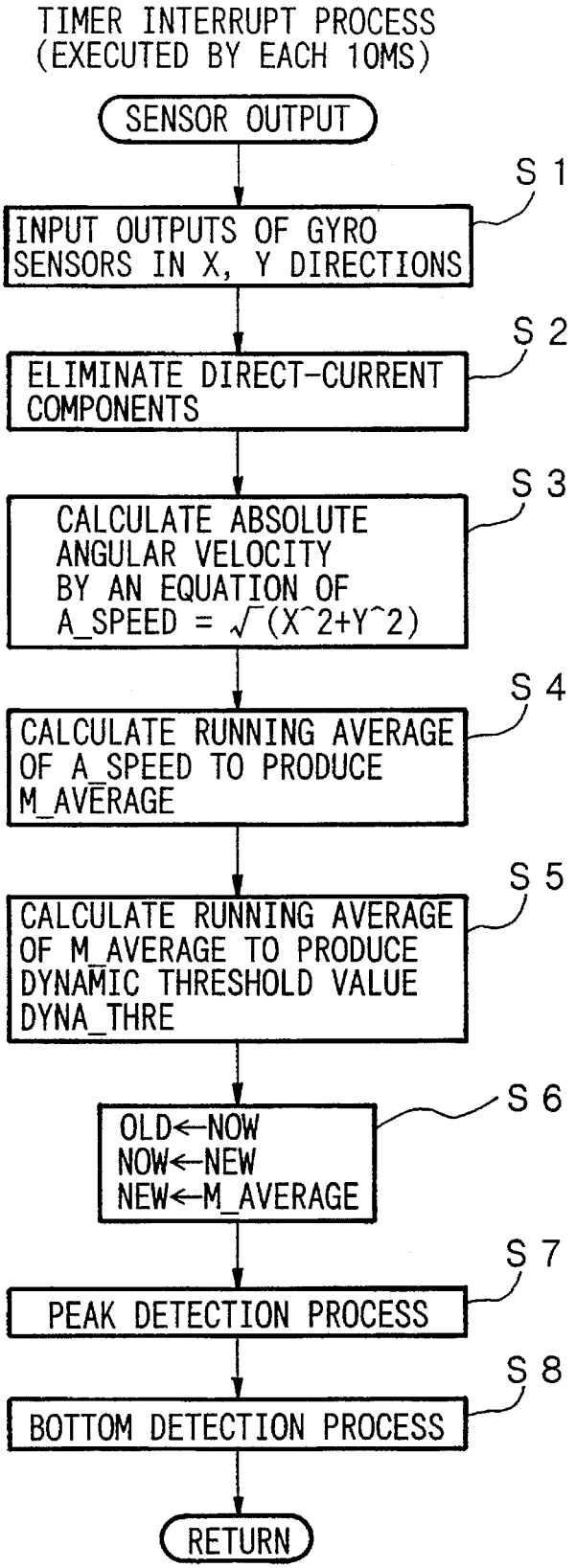
FIG. 4 is a flowchart showing timer interrupt process.

FIG. 4 is a flowchart showing timer interrupt process. The timer interrupt process is executed by every 10 ms. This timer interrupt process is a routine which processes detection data of the gyro sensors. In first step S1, the CPU 10 inputs the angular velocity data of X direction and Y direction from the A/D converter circuits 16 and 19. In next step S2, direct-current components are removed from the angular velocity data. Because, the direct-current components, corresponding to rotation of constant velocity, are not required for detection of a peak of angular velocity representing a beat timing. In step S3, the CPU 10 detects absolute angular velocity based on the angular velocity data of X direction and Y direction from which the direct-current components are removed. The absolute angular velocity A_SPEED is composition of angular velocities in X direction and Y direction and is calculated by an equation, as follows:

$$A_SPEED=\sqrt{(X^2+Y^2)}$$

In step S4, a running average (or running mean) M_AVERAGE for the absolute angular velocity A_SPEED is calculated as data which are actually used for detection of a peak of angular velocity. The running average M_AVERAGE is an average value among a plurality of data of the absolute angular velocity A_SPEED which have been previously detected by a certain number of times. Such an averaging process contributes to elimination of dispersion and elimination of noise in detection values. In step S5, the CPU 10 calculates a dynamic threshold value DYNA_THRE. This dynamic threshold value DYNA_THRE is obtained by subjecting the running average M_AVERAGE to further running-average operation. So, the dynamic threshold value DYNA_THRE gradually follows variation of angular velocity. This dynamic threshold value DYNA_THRE is used to make a decision as to a peak of angular velocity.

After completion of calculations described above, contents of registers are renewed in step S6. Herein, the registers, which are renewed, are designated by symbols of 'NEW', 'NOW' and 'OLD' respectively. The register NEW stores a current detection value of M_AVERAGE; the register NOW stores a preceding detection value which occurs prior to the current detection value; and the register OLD stores a previous detection value which occurs prior to the preceding detection value. Renewal of the registers is executed in accordance with procedures, as follows:

Content of the register NOW is transferred to the register OLD; content of the register NEW is transferred to the register NOW; and M_AVERAGE is set into the register NEW.

Next, the CPU 10 executes peak detection process in step S7. The peak detection process is a routine which detects a peak of angular velocity, representing a beat timing, as shown in FIG. 3B. Details of the peak detection process will be explained in conjunction with FIG. 5. Then, the CPU 10 executes bottom detection process in step S8. The bottom detection process is a routine whose function is reverse to that of the peak detection process. In other words, the bottom detection process is a routine which detects a point of a minimum value of angular velocity, i.e., a bottom of angular velocity. After completing the step S8, program control returns to an original state.

Figure 5:
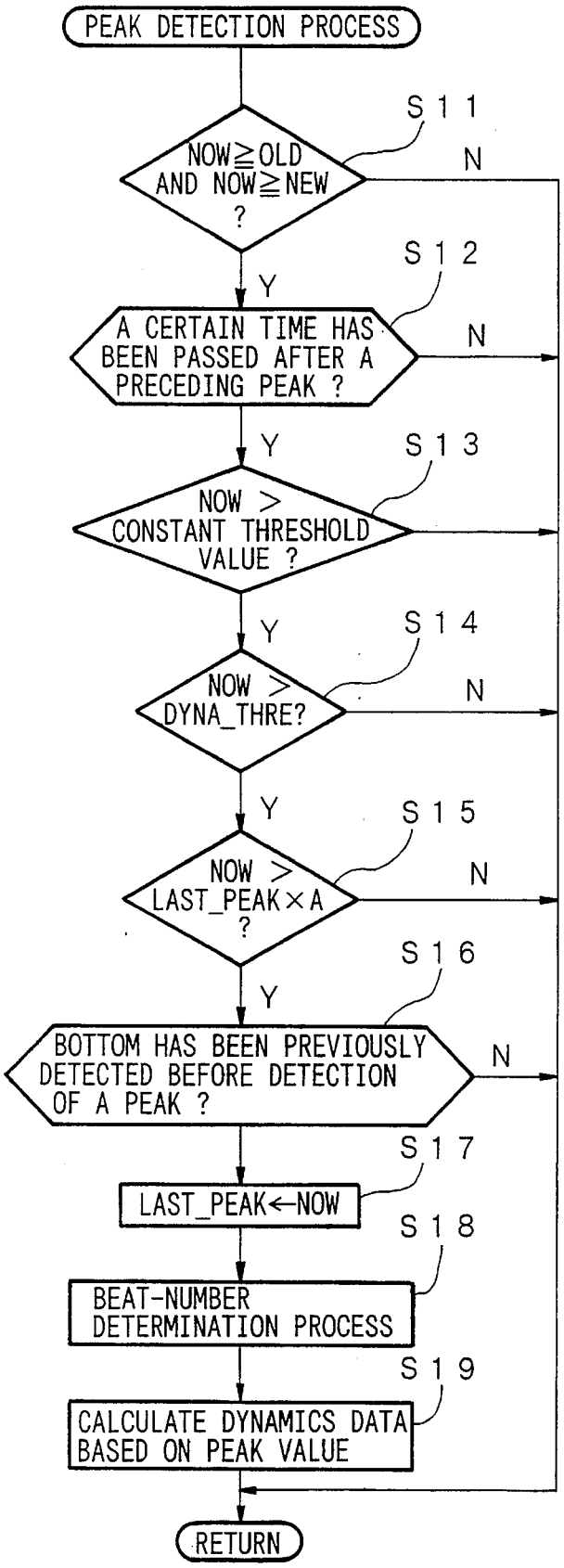
FIG. 5 is a flowchart showing peak detection process.

FIG. 5 is a flowchart showing the peak detection process. Herein, steps S11 to S16 make a decision as to whether or not the content of the register NOW (i.e., a preceding value of M_AVERAGE) represents a peak of angular velocity. The CPU 10 determines that the content of the register NOW represents a peak of angular velocity if it meets all of conditions, as follows:

i) The following inequalities are established (see step S11).

$$NOW \geqq OLD \text{ and } NOW \geqq NEW$$

ii) At least a certain time has been passed after a preceding peak (see step S12).

The above condition is made based on a precondition that performance of the music does not provide an extremely short interval of time between peaks (or beats). So, the CPU 10 determines a peak, occurring at a timing which is not a certain time later than occurrence of a preceding peak, as noise.

iii) A value of the register NOW is not less than a constant threshold value (see FIG. 3B; step S13).

iv) A value of the register NOW is not less than the dynamic threshold value DYNA_THRE (see step S14).

That is, if the value of the register NOW is less than the aforementioned threshold values, the CPU 10 determines that the value of the register NOW does not represent a true peak but noise.

v) A value of the register NOW is equal to a value of LAST_PEAK×A (where 'LAST_PEAK' represents a value of a preceding peak; 'A' represents a constant value which is set in a range of $0<A\leqq 1$) (see step S15).

The above condition is made based on assumption that in normal conducting (or normal hand-swing motion of the hand controller 1), big difference may not occur between a current peak value and a preceding peak value. So, the CPU 10 determines a value of the register NOW, which is extremely smaller than the preceding peak value, as noise.

vi) A bottom of angular velocity should be detected just before a peak is detected (see step S16).

Because, a bottom naturally occurs between peaks. So, a peak, which does not follow a bottom, is determined as noise.

If a peak is detected based on the aforementioned conditions, a value of the register NOW is set into LAST_PEAK (see step S17). This LAST_PEAK is used as a reference value for detection of a next peak. Thereafter, the CPU 10 proceeds to step S18 in which beat-number determination process is carried out. The beat-number determination process is designed to make a decision as to which of beats in triple time corresponds to a current peak; in other words, the beat-number determination process is used to detect a beat number specifying one of beats in triple time. Details of the beat-number determination process will be described with reference to FIGS. 6 to 8. Next, the CPU 10 proceeds to step S19 in which dynamics data, which are used for tone-volume control, are calculated based on a current peak value. If angular velocity is relatively large, the apparatus determines that the human operator requests big sound, so that the tone volume is controlled to become bigger. The dynamics data can be calculated by a specific operation expression; or the dynamics data can be obtained by referring to a table. Then, addition or multiplication is performed between the dynamics data and velocity data of performance data, thus performing the tone-volume control. Incidentally, the tone-volume control can be performed by changing 'Volume' and 'Expression', both of which are MIDI messages.

Figure 6:
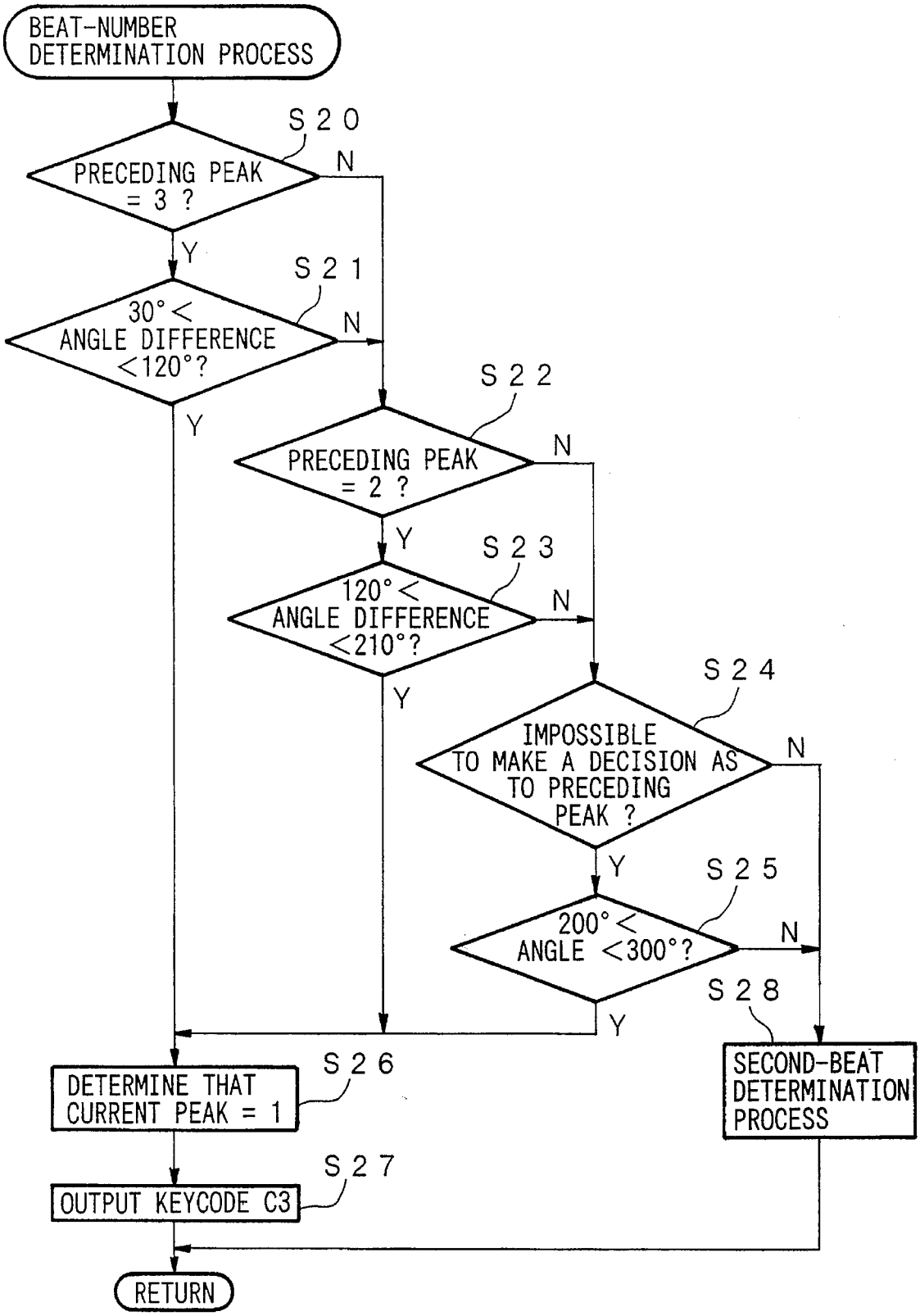
FIG. 6 is a flowchart showing beat-number determination process.
Figure 7:
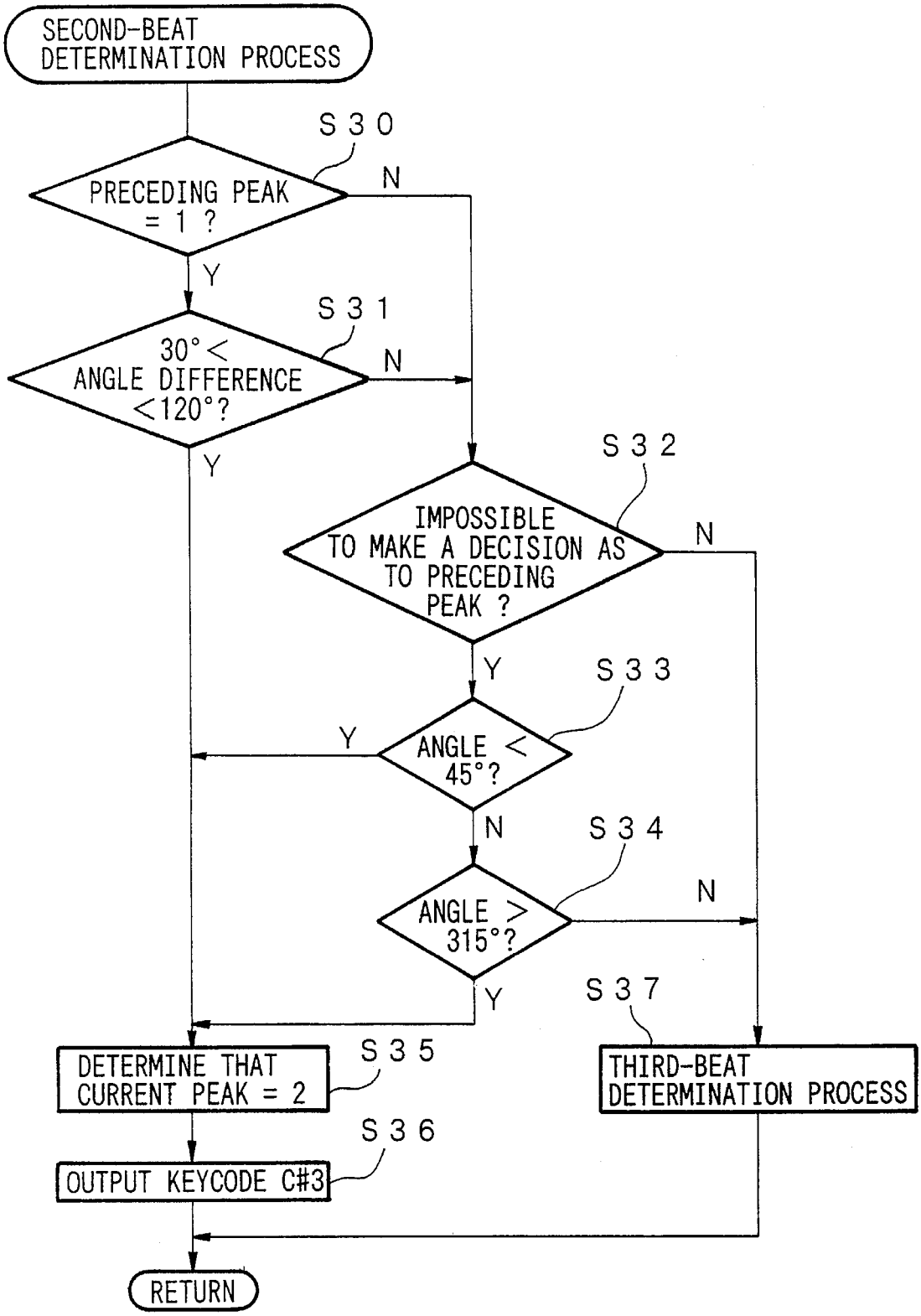
FIG. 7 is a flowchart showing second-beat determination process.
Figure 8:
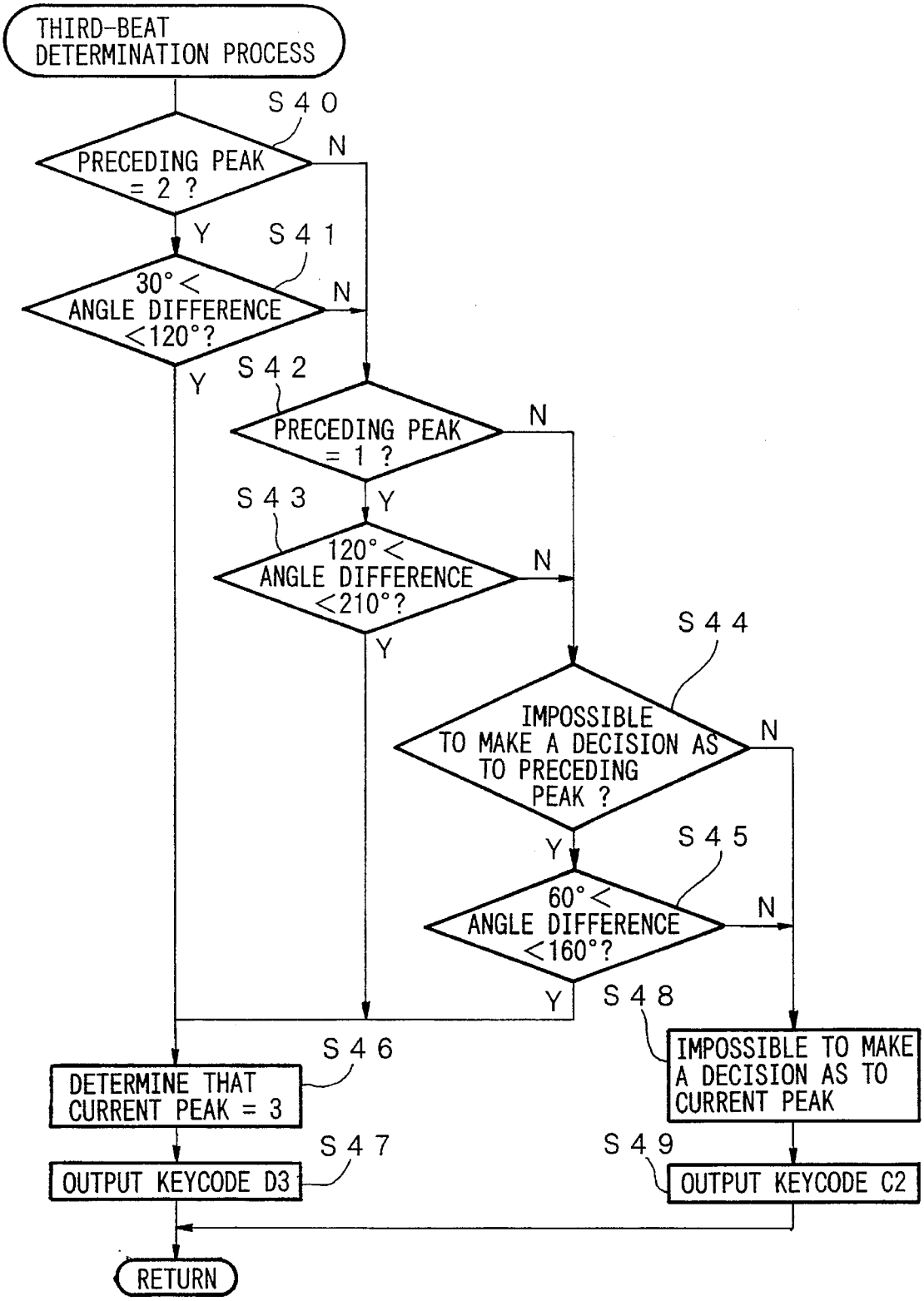
FIG. 8 is a flowchart showing third-beat determination process.
Figures 9A, 9B, 9C, 9D, 9E, 9F:
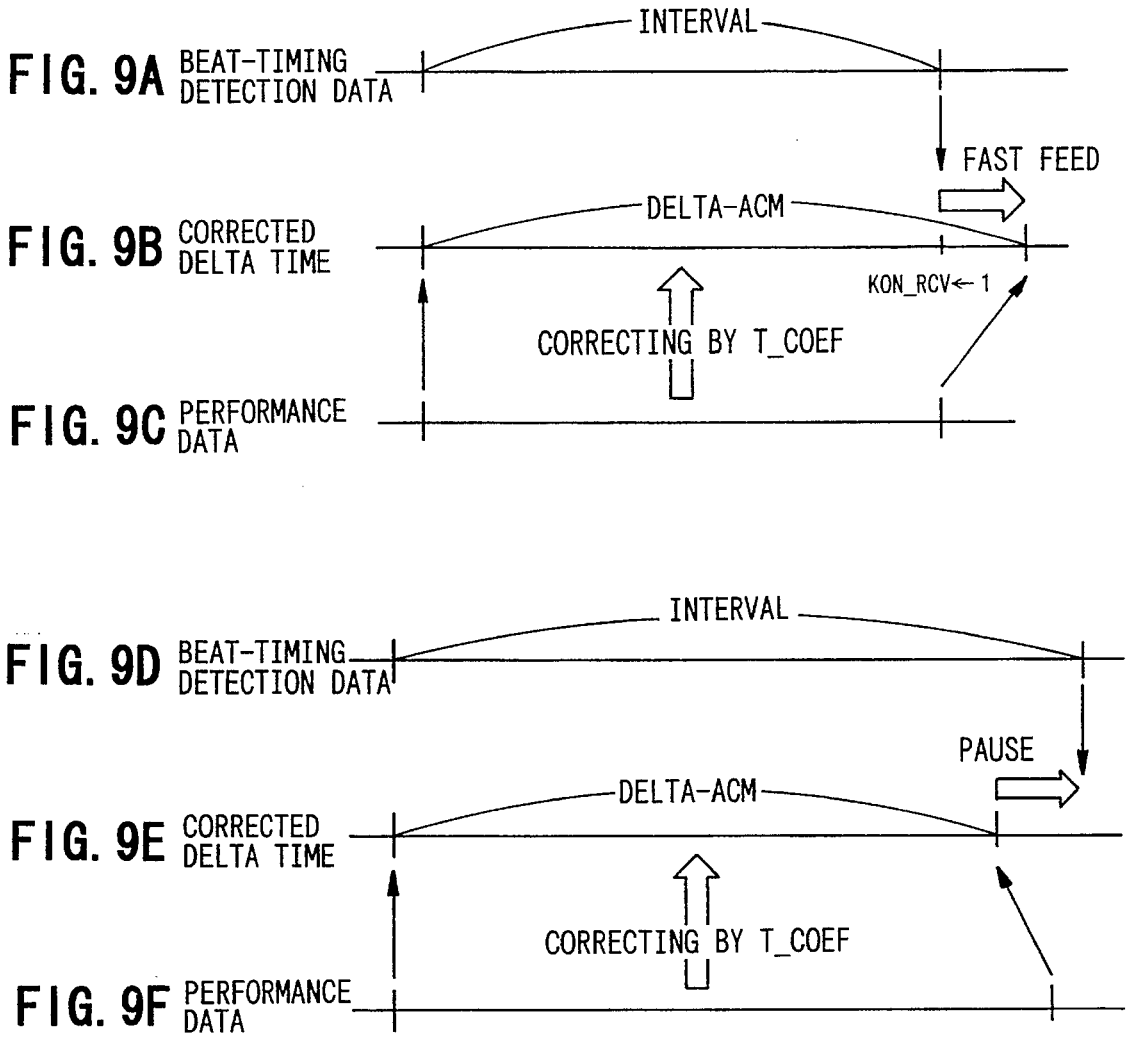
FIGS. 9A, 9B, 9C, 9D, 9E and 9F are time charts showing data which are used to explain tempo control performed by the electronic musical instrument having the automatic performance function.

FIGS. 6, 7 and 8 are flowcharts showing routines of the beat-number determination process.

FIG. 6 shows a routine which detects a first beat (i.e., PEAK=1) in triple time. At first, step S20 makes a decision as to whether or not a preceding peak designates a third beat in triple time. If so, the CPU 10 proceeds to step S21 which makes a decision as to whether or not angle difference 'dθ' meets a condition represented by an angular range of $30° < d\theta < 120°$. If the angle difference dθ meets the condition, program control jumps to step S26, wherein the CPU 10 determines that a current peak designates a timing of a first beat. Herein, an angle θ is provided between detection values X and Y of a current angular velocity. That is, the detection values X and Y are plotted in a X-Y plane to set a point of coordinates (X,Y) (see FIG. 3C); and then, the angle θ is provided between a X axis and a line segment which is formed between the point of coordinates (X,Y) and an origin (0,0). So, the angle different dθ corresponds to difference between the angle θ for the current angular velocity and another angle which is made based on detection values of a preceding angular velocity. If the human operator accurately swings the hand controller 1, the angle difference dθ should be 60° which corresponds to a vertex angle of the equilateral triangle. So, hand-swing motion applied to the hand controller 1 may belong to the aforementioned angular range in a normal state. Next, if the preceding peak designates a second beat in triple time (i.e., PEAK=2), program control goes to step S23 through step S22; and consequently, the CPU 10 determines in step S26 that the current peak designates the first beat (i.e., PEAK=1) if the angle difference d belongs to an angular range of $120° < d\theta < 210°$. If it is impossible to make a decision as to which of the beats in triple time corresponds to the preceding peak, program control goes to step S25 through step S24; and consequently, the CPU 10 determines in step S26 that the current peak designates the first peak (i.e., PEAK=1) if the angle θ belongs to an angular range of $200° < \theta < 300°$. If the CPU 10 determines that the current peak designates the first beat in triple time (i.e., PEAK=1), program control goes to step S27 in which the MIDI interface 28 outputs note-on data having a keycode 'C3' assigned to CHANNEL 1 of MIDI. On the other hand, if all of the conditions of steps S21, S23 and S25 are not satisfied, program control goes to step S28 in which second-beat determination process is carried out. In the second-beat determination process, a decision is made as to whether or not the current peak designates a timing of a second beat.

FIG. 7 shows details of the second-beat determination process. As described before, this process is executed to make a decision as to whether or not the current peak designates a timing of a second beat. At first, if the preceding peak designates the timing of the second beat, program control goes to step S31 through step S30, wherein a decision is made as to whether or not the angle difference dθ belongs to an angular range of 30°<dθ<120°. If the angle difference dθ belongs to the angular range, the CPU 10 determines in step S35 that the current peak designates the second beat (i.e., PEAK=2). If it is impossible to make a decision as to which of beats in triple time corresponds to the preceding peak, program control goes to a series of steps S33 and S34 through step S32. Herein, if the angle θ belongs to either an angular range of θ<45° or an angular range of θ>315°, the CPU 10 determines in step S35 that the current peak designates the second beat (i.e., PEAK=2). If a decision of PEAK=2 is established, the MIDI interface 28 outputs note-on data having a keycode of C#3 assigned to CHANNEL 1 of MIDI in step S36. On the other hand, if all of the conditions of steps S31, S33 and S34 are not satisfied, the CPU 10 proceeds to third-beat determination process in step S37 which makes a decision as to whether or not the current peak designates a timing of a third beat.

FIG. 8 shows the third-beat determination process which makes a decision as to whether or not the current peak designates a timing of a third beat (i.e., PEAK=3). At first, if the preceding peak designates a second beat (i.e., PEAK=2), program control goes to step S41 through step S40, wherein a decision is made as to whether or not the angle difference dθ belongs to an angular range of 30°<dθ<120°. If the angle difference dθ belongs to the angular range, program control goes to step S46 in which the CPU 10 determines that the current peak designates the third beat (i.e., PEAK=3). Next, if the preceding peak designates a first beat (i.e., PEAK=1), program control goes to step S43 through step S42, wherein a decision is made as to whether or not the angle difference dθ belongs to an angular range of 120°<dθ<210°. If the angle difference dθ belongs to the angular range, the CPU 10 determines in step S46 that the current peak designates the third beat (i.e., PEAK=3). By the way, if it is impossible to make a decision as to which of beats in triple time corresponds to the preceding peak, program control goes to step S45 through step S44. In that case, if the angle θ belongs to an angular range of 60°<θ<160°, the CPU 10 determines in step S46 that the current peak designates the third beat (i.e., PEAK=3). If a decision of PEAK=3 is established, the MIDI interface 28 outputs note-on data having a keycode of D3 assigned to CHANNEL 1 of MIDI. On the other hand, if all of the conditions of step S41, S43 and S45 are not satisfied, program control goes to step S48, wherein the CPU 10 makes a final conclusion that it is impossible to make a decision as to which of beats in triple time corresponds to the current peak. Then, program control goes to step S49 in which the MIDI interface 28 outputs note-on data having a keycode of C2 assigned to CHANNEL 1 of MIDI. In other words, the keycode C2 is used as data indicating that the apparatus detects a peak corresponding to an uncertain beat timing which cannot be matched with any of the beats in triple time.

Thanks to the aforementioned processes, the CPU 10 makes a decision as to which of the beats in triple time corresponds to the peak of angular velocity currently detected. So, beat-timing detection data are created based on a beat timing corresponding to the peak. The beat-timing detection data are transmitted to the electronic musical instrument EI through the MIDI interface 28. The electronic musical instrument EI controls a tempo of a tune, whose automatic performance is not progressing, in response to the beat-timing detection data. Incidentally, the angle and angle difference which are used by the aforementioned processes are merely examples of parameters or elements used for beat-number determination. So, it is possible to use another angle and another angle difference for the beat-number determination. In addition, it is possible to employ conditions, other than the aforementioned conditions relating to the angular ranges, for basis of the beat-number determination.

Next, operation of the electronic musical instrument EI, relating to the automatic performance control apparatus, will be described with reference to FIGS. 9A to 9F and FIGS. 10 to 12.

Figure 10:
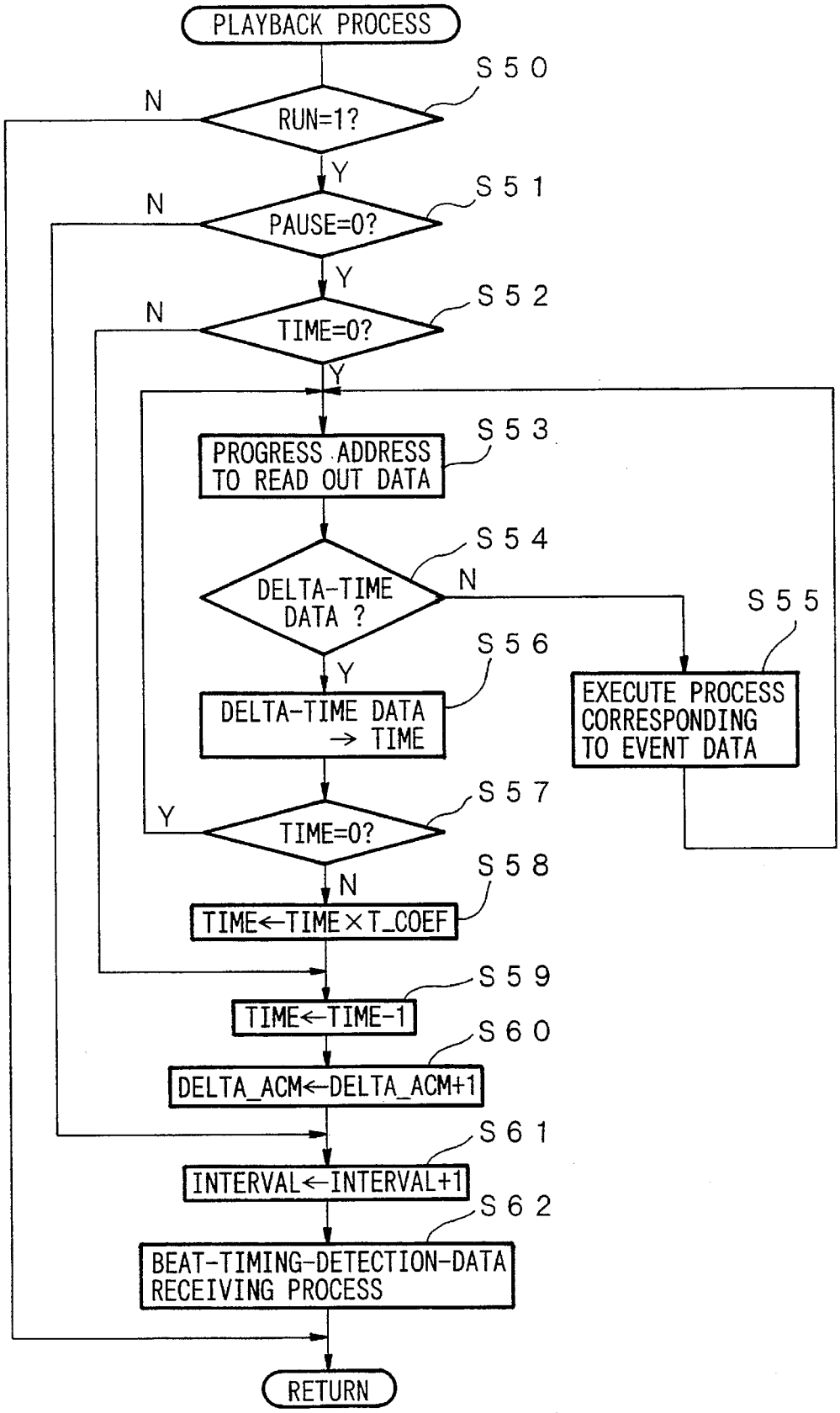
FIG. 10 is a flowchart showing timer interrupt process in playback of automatic performance.
Figure 11:
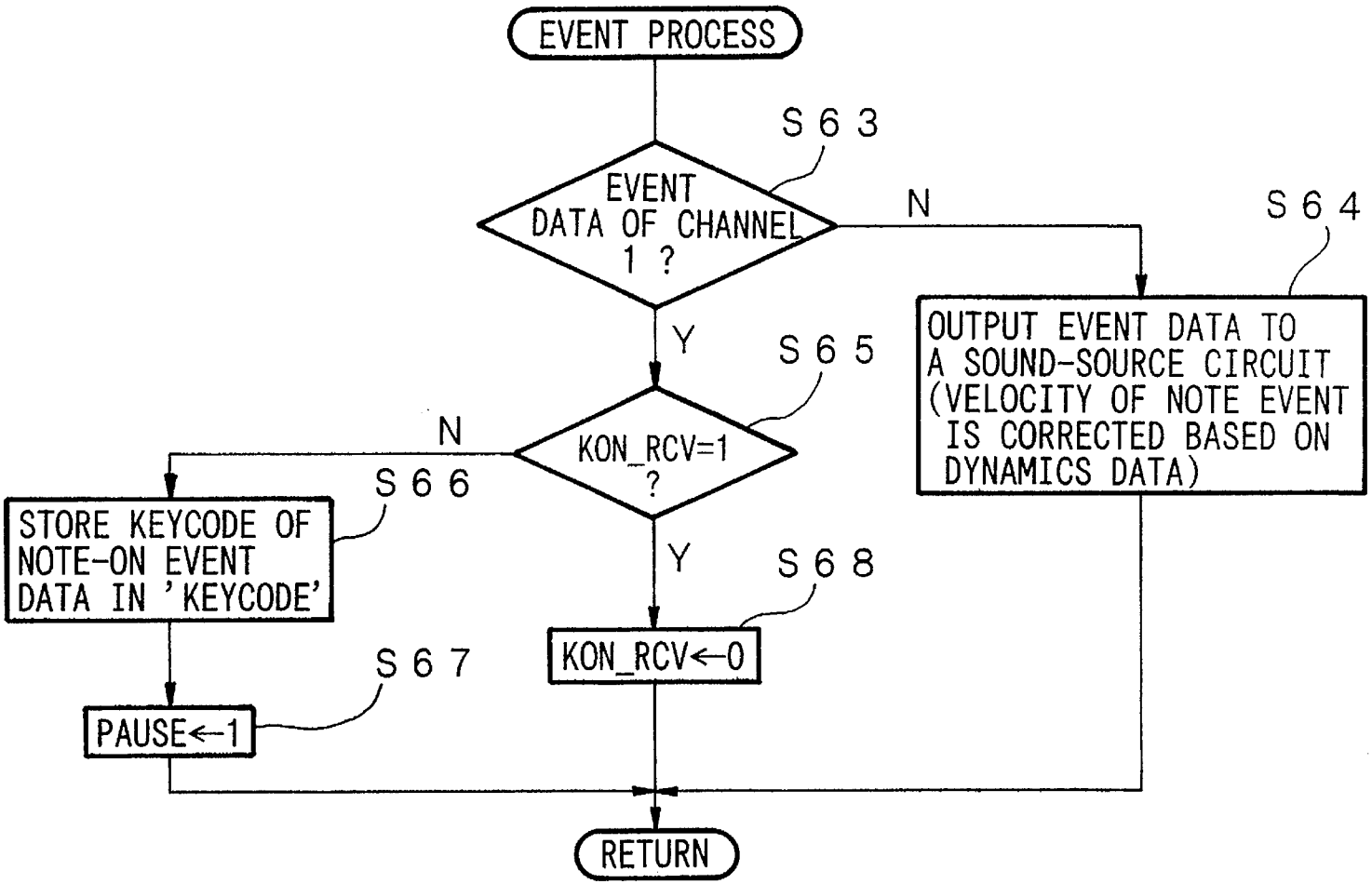
FIG. 11 is a flowchart showing event process.
Figure 12:
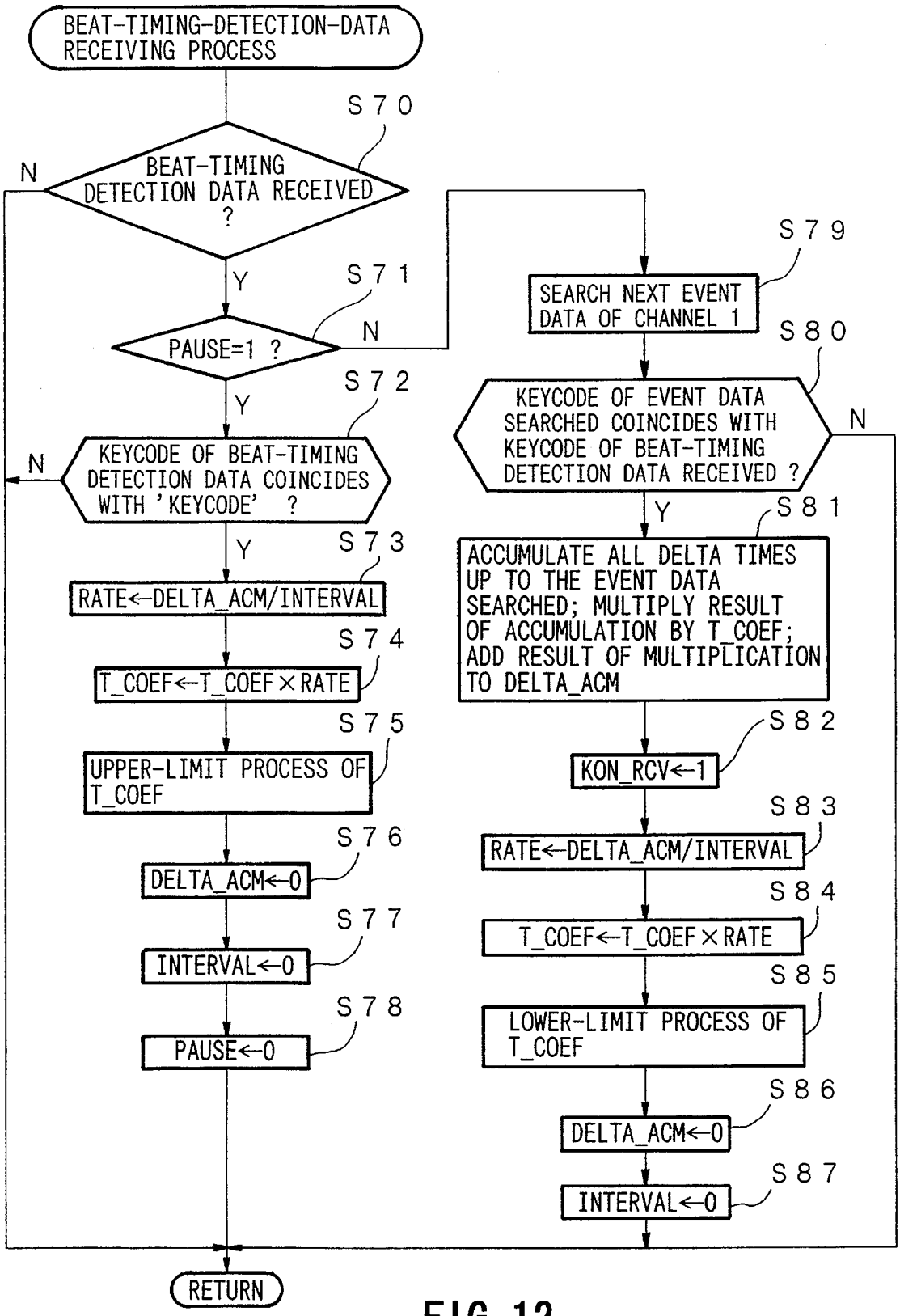
FIG. 12 is a flowchart showing beat-timing-detection-data receiving process.

FIGS. 9A to 9F are time charts showing data which are used to explain tempo control of automatic performance made by the electronic musical instrument EI. FIGS. 10 to 12 are flowcharts showing routines of the electronic musical instrument EI.

As performance data stored by the electronic musical instrument EI, there are provided event data and delta-time data which are used alternatively. Herein, the delta-time data represent an interval of time between two event data. The event data are stored in a mixed manner with respect to TRACK 1 (i.e., CHANNEL 1 of MIDI) to TRACK 16 (i.e., CHANNEL 16 of MIDI). Herein, certain event data (i.e., note-on event data) are stored as beat-timing data in TRACK 1 (i.e., CHANNEL 1 of MIDI). The event data of TRACK 1 are stored by each beat timing. So, in case of a tune of triple time, keycodes of event data are arranged in an order of C3, C#3, D3, C3, C#3, . . . . The delta-time data are based on a unit of milli-second (ms). When changing a tempo of automatic performance, delta-time data are multiplied by a certain tempo coefficient T_COEF, so that an interval of time between event data is changed. In that case, if the tempo coefficient T_COEF has a value '1', the tempo is not changed. However, the tempo is made slow if the tempo coefficient is greater than '1' whilst the tempo is made fast if the tempo coefficient is less than '1'.

Next, a description will be given with respect to a method of calculation of the tempo coefficient T_COEF. Original delta-time data, representing an interval of time between beats (i.e., beat interval) for performance data, are corrected by the tempo coefficient T_COEF which is set just before occurrence of the performance data. So, a deviation rate RATE is calculated between a corrected beat interval DELTA_ACM and a beat interval INTERVAL, which is designed by manipulating the hand controller 1, in accordance with an equation, as follows:

$$RATE=INTERVAL/DELTA_ACM$$

For beat-interval control, the tempo coefficient T_COEF is multiplied by the deviation rate so that the tempo coefficient T_COEF is renewed by each beat.

FIG. 10 shows playback process for automatic performance, which is carried out by timer interrupt process executed in every 1 ms. At first, steps S50 to S52 are used to make a decision as to whether or not a current timing matches with a read-out timing for automatic performance data. Herein, 'RUN' designates an automatic performance flag. If RUN=1, It is declared that automatic performance is now progressing. 'PAUSE' designates a pause flag. If PAUSE=1, it is declared that progression of the automatic performance is temporarily stopped. 'TIME' designates a duration-time register. This register is used to set an interval of time (i.e., delta time) for a read-out operation of next automatic performance data, so that the delta time is counted down. If TIME=0, it is declared that a current timing matches with a read-out timing for the next automatic performance data. Thus, If all of conditions of RUN=1, PAUSE=0 and TIME=0 are established, in other words, if program control goes to step S53 through steps S50, S51 and S52, it is determined that a current timing is a read-out timing for next data.

In step S53, an address for automatic performance data is progressed, so that next data are read out. In next step S54, a decision is made as to whether read data represent event data or delta-time data. In case of the event data, program control goes to step S55 in which event process, relating to the event data, is carried out. After completion of the step S55, program control returns to step S53.

In case of the delta-time data, program control goes to step S56 through step S54, wherein the delta-time data are set into the register TIME. If a value '0' is set into the register TIME, in other words, if multiple events occur simultaneously, program control returns to step S53 through step S57. On the other hand, if the value '0' is not set into the register TIME, program control goes to step S58 in which content of the register TIME is corrected by being multiplied by a tempo coefficient T_COEF. This tempo coefficient T_COEF is used to correct a speed of a tune, whose automatic performance is now progressing, on the basis of beat-timing detection data (representing any one of key-on events of C3, C#3, D3 and C2) which are transferred from the MIDI interface 28. A method of calculation of the tempo coefficient T_COEF will be described later.

Thereafter, program control goes to step S59 in which the content of the register TIME is decreased by '1'. In next step S60, content of a register DELTA_ACM is increased by '1'. Herein, the register DELTA_ACM is used to accumulate 'corrected' delta-time data of performance data for one beat. The steps S59 and S60 are carried out if the step S52 determines that the content of the register TIME is not zero or if all the steps S53 to S58 are completed. In step S61, content of a register INTERVAL is increased by '1'. The register INTERVAL is used to accumulate delta-time data, designated by the human operator, for one beat in a duration between two beat-timing detection data consecutively inputted. In next step S62, beat-timing-detection-data receiving process is carried out. Details of the beat-timing-detection-data receiving process will be described later with reference to FIG. 12. Both of the steps S61 and S62 must be executed if automatic performance is carried out.

FIG. 11 is a flowchart showing event process. This process is executed if event data are read out in connection with a readout operation of automatic performance data (see step S55 in FIG. 10). As described before, event data for CHANNEL 1 are stored as beat-timing data. So, first step S63 makes a decision as to whether or not event data currently read out coincide with data of CHANNEL 1. If the event data do not coincide with the data of CHANNEL 1, program control goes to step S64 in which the event data are supplied to a sound-source circuit so that operations relating to the event data are carried out. Herein, velocity of a note event is corrected in response to dynamics data which are calculated based on data of angular velocity (see step S19 in FIG. 5).

On the other hand, if the event data coincide with the data of CHANNEL 1, program control goes to step S65 in which a decision is made as to whether or not '1' is set into a beat-timing-detection-data receiving flag KON_RCV. '1' is set into the beat-timing-detection-data receiving flag KON_RCV when the electronic musical instrument EI receives beat-timing detection data from the automatic performance control apparatus before beat-timing data of automatic performance data are read out. Therefore, an event of KON_RCV=1 indicates that a tempo actually performed is slower than a tempo designated by the human operator (see FIGS. 9A to 9C). In such an event, process corresponding to event data (i.e., aforementioned beat-timing data) has been executed when the electronic musical instrument EI inputs the beat-timing detection data (see steps S79 to S87 in FIG. 12). So, the flag KON_RCV is reset in step S68; and then, program control returns. On the other hand, in case of an event of $KON_{_RCV=}0$, a keycode of note-on event data is stored in a register KEYCODE in step S66. In that case, automatic performance may progress faster because the beat-timing data are read out prior to a timing at which the human operator designates a beat timing. So, '1' is set into a register PAUSE, so that progression of the automatic performance is temporarily stopped in step S67. However, generation of sound is continued, regardless of temporary stop of the automatic performance.

FIG. 12 shows the beat-timing-detection-data receiving process. In first step S70, a decision is made as to whether or not beat-timing detection data are received. If the beat-timing detection data are not received, program control returns without executing any step in this routine. If the beat-timing detection data are received, in other words, if the beat-timing detection data are stored in a buffer when program control enters into this routine, program control goes to step S71. In step S71, a decision is made as to whether or not an event of PAUSE=1 currently occurs, in other words, whether or not the beat-timing data of the automatic performance data have been already read out. In the event of PAUSE=1, program control goes to step S72 which makes a decision as to whether or not a keycode of the beat-timing detection data received coincides with content of the register KEYCODE which is set in the step S66 of FIG. 11. If the keycode does not coincide with the content of the register KEYCODE, it is determined not to respond to a tempo designated by the human operator. So, program control returns. If the keycode coincides with the content of the register KEYCODE, it is determined that the automatic performance, which is now stopped to wait for designation of a beat, can be re-started. So, content of the register PAUSE is reset to zero in step S78, so that the automatic performance is re-started. However, before re-starting of the automatic performance, a tempo of the automatic performance does not coincide with a tempo designated by the human operator. So, it is necessary to correct the tempo by steps S73 to S77 before re-starting of the automatic performance. In step S73, a deviation rate RATE, which represents a deviation of tempo by a ratio between count values, is calculated in accordance with an equation, as follows:

$$RATE=INTERVAL/DELTA_ACM$$

In a current situation, a value of INTERVAL is greater than a value of DELTA_ACE, so that RATE should be greater than '1'. So, a tempo for a previous beat should be corrected by an amount of RATE. Therefore, a tempo coefficient T_COEF for the previous beat is corrected by being multiplied by RATE in step S74; in other words, calculation is performed, as follows:

$$T_COEF=T_COEF\times RATE$$

Since RATE is greater than '1', the tempo coefficient T_COEF is increased by the above calculation, so that the tempo is made slow. If the tempo coefficient T_COEF exceeds an upper-limit value due to execution of the above calculation, in other words, if the tempo becomes slower than a slowest tempo among tempos which can be performed, limit process is performed in step S75. Herein, the tempo coefficient T_COEF is limited to the upper-limit value. Thereafter, '0' is set into DELTA_ACM in step S76; '0' is set into INTERVAL in step S77; and content of PAUSE is reset to zero in step 78.

Meanwhile, an event of PAUSE=0 in step S71 indicates that the beat-timing data of the automatic performance data have not been read out yet. In such an event, program control goes to step S79 in which searching is performed to find out next event data for TRACK 1 from the automatic performance data because it is indicated that the tempo of the automatic performance is slower than the tempo designated by the human operator. In next step S80, a decision is made as to whether or not a keycode of the event data searched coincides with a keycode of beat-timing detection data received. If they do not coincide with each other, it is determined not to respond to the tempo designated by the human operator. Hence, program control returns. If they coincide with each other, program control goes to step S81. In step S81, all of delta times, which exist between a current location of the automatic performance and the event data searched, are accumulated; and then, result of accumulation is multiplied by the tempo coefficient T_COEF; thereafter, result of multiplication is added to DELTA_ACM. Thus, delay of the automatic performance can be eliminated. However, event data, which exist between the current location of the automatic performance and the event data searched, are not used for execution of automatic performance. In order to cope with such an un-executed situation of the event data, it may be necessary to carry out performance with delta-time data being shortened in parallel with elimination of the delay of the automatic performance.

In step S82, '1' is set into KON_RCV. Before the step S82, it is detected that the tempo of the automatic performance does not coincide with the tempo designated by the human operator. So, it is necessary to correct the tempo by steps S83 to S87. In step S83, a deviation rate RATE, which represents a deviation of the tempo by a ratio between count values, is calculated, as follows:

RATE=INTERVAL/DELTA_ACM

At the step S83, a value of INTERVAL is smaller than a value of DELTA_ACM; therefore, RATE should be less than '1'. In step S84, the tempo coefficient T_COEF is corrected by being multiplied by RATE. Since RATE is smaller than '1', the tempo coefficient T_COEF is decreased, so that the tempo is made faster. If the tempo coefficient T_COEF becomes smaller than a lower-limit value due to execution of the above calculation, in other words, if a tempo becomes faster than a fastest tempo among tempos which can be performed, limit process is performed in step S85. Herein, the tempo coefficient is limited to the lower-limit value. Thereafter, '0' is set into DELTA_ACM in step S86; and then, '0' is set into INTERVAL in step S87.

Thanks to the aforementioned operations, the tempo of the automatic performance is controlled to respond to the tempo which is designated by the human operator who swings the hand controller 1. In addition, dynamics (i.e., tone volume) are controlled responsive to intensity of swinging of the hand controller 1.

Figure 13:
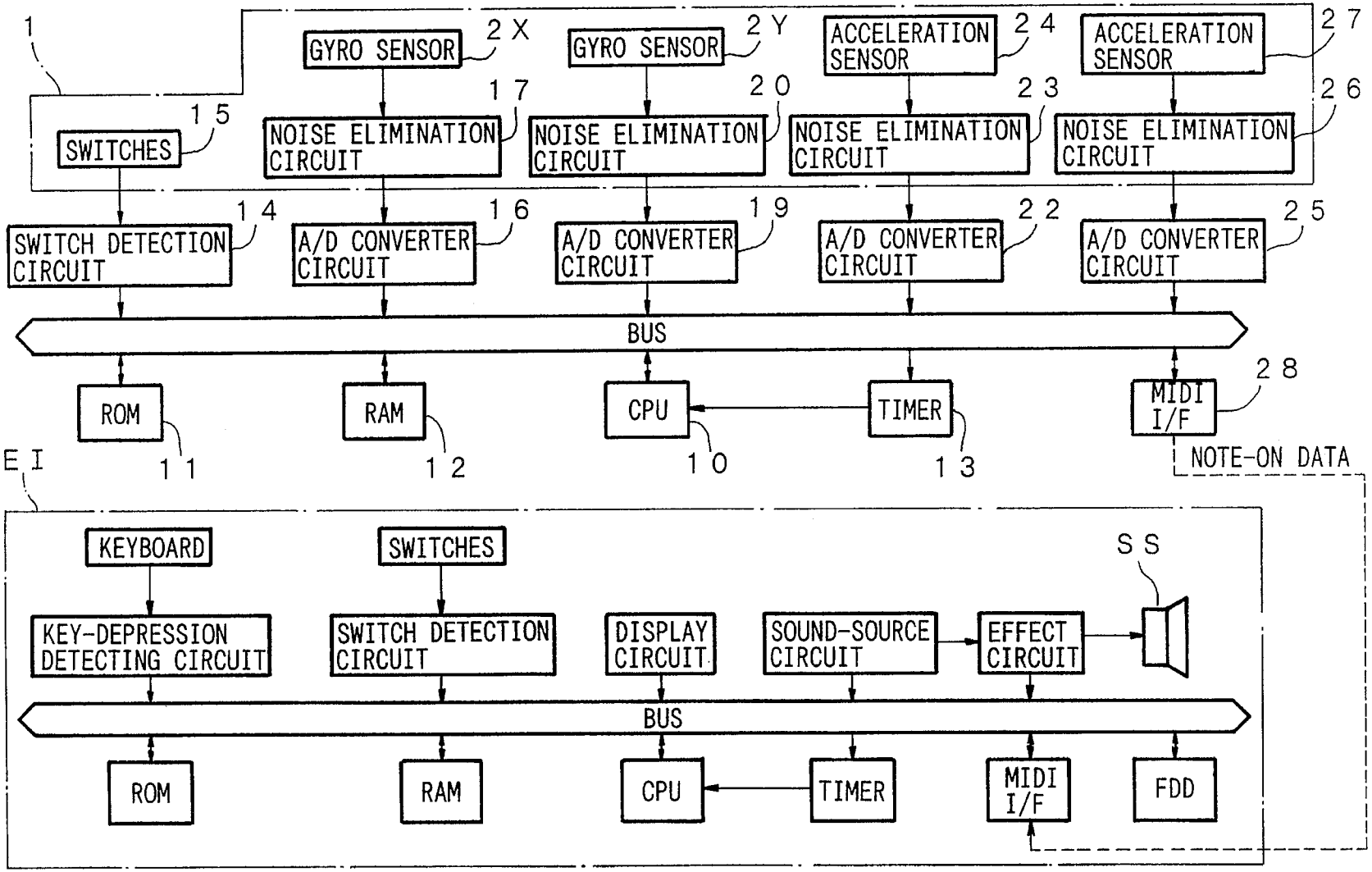
FIG. 13 is a block diagram showing another example of automatic performance control apparatus which cooperates with the electronic musical instrument.
Figure 14:
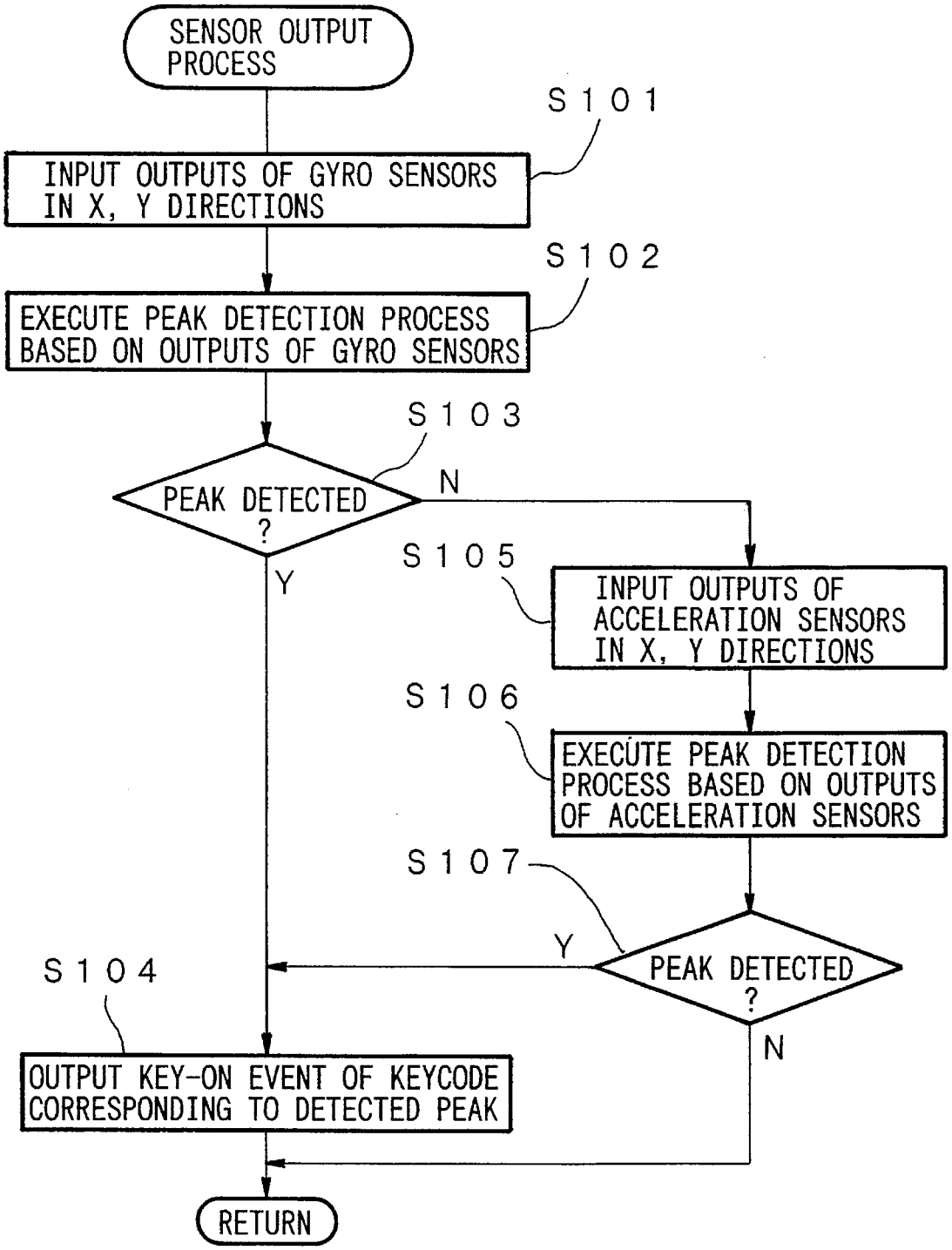
FIG. 14 is a flowchart showing sensor output process executed by the automatic performance control apparatus of FIG. 13.
Figure 15:
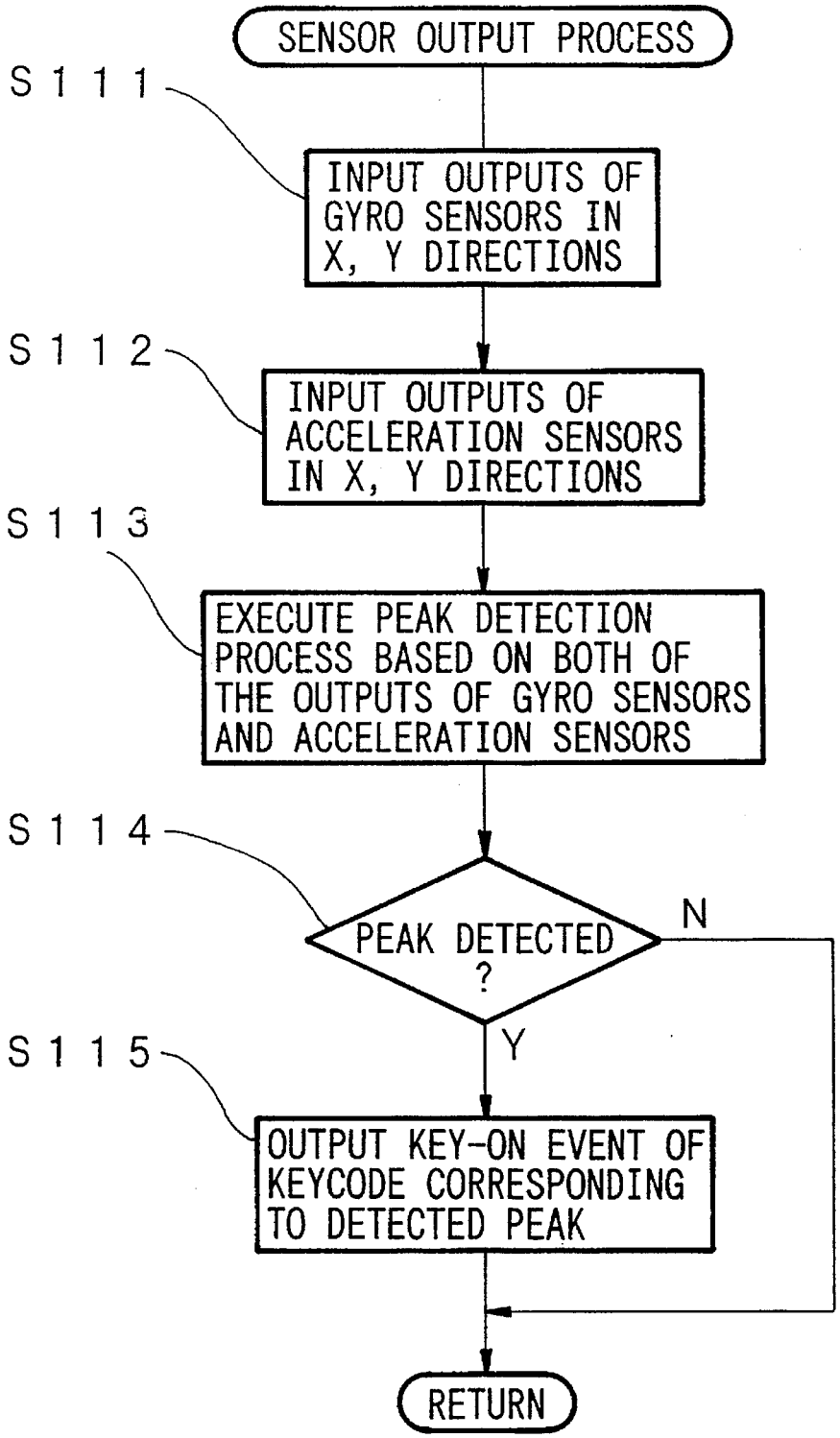
FIG. 15 is a flowchart showing another example of sensor output process.

FIGS. 13 to 15 are provided for a modified example of the automatic performance control apparatus. Herein, FIG. 13 is a block diagram showing a configuration of the modified example of the automatic performance control apparatus which is connected to the electronic musical instrument EI, wherein parts equivalent to those of FIG. 2 will be designated by the same numerals; hence, the description thereof will be omitted. Difference between the automatic performance apparatuses shown by FIGS. 2 and 13 lies in provision of acceleration sensors. In the automatic performance control apparatus of FIG. 13, acceleration sensors are attached to the hand controller 1, so that the acceleration sensors cooperate with the gyro sensors to assist peak detection.

Like the aforementioned gyro sensors 2X and 2Y, acceleration sensors 24 and 27 are arranged in X and Y directions. A detection value of the acceleration sensor 24 is supplied to an A/D converter circuit 22 through a noise elimination circuit 23 whilst a detection value of the acceleration sensor 27 is supplied to an A/D converter circuit 25 through a noise elimination circuit 26. The A/D converter circuits 22 and 25 convert the detection values to data, so that the data are read by the CPU 10. The data are used to execute sensor output process shown in FIG. 14 or FIG. 15.

FIG. 14 shows one example of the sensor output process. This process is designed to give first consideration to detection values of the gyro sensors 2X, 2Y rather than detection values of the acceleration sensors 24, 27. In first step S101, the automatic performance control apparatus of FIG. 13 (hereinafter, simply called the apparatus) inputs outputs of the gyro sensors 2X, 2Y in X, Y directions. In next step S102, the apparatus executes peak detection process based on detection values of the gyro sensors 2X, 2Y. Procedures of the peak detection process, executed by the apparatus, are similar to those shown by FIGS. 4 to 8; hence, the detailed description thereof will be omitted. If a peak is detected by the peak detection process, program control goes to step S104 through step S103. In step S104, the apparatus outputs a key-on event of a keycode corresponding to the detected peak through the MIDI interface 28.

If a peak is not detected, program control goes to step S105 In which the apparatus in turn Inputs outputs of the acceleration sensors 24, 27 in X, Y directions. In next step S106, the apparatus executes peak detection process based on detection values of the acceleration sensors 24, 27. If a peak is detected by the peak detection process executed by the step S106, program control goes to step S104 through step S107, so that the apparatus outputs a note-on event of a keycode corresponding to the detected peak. If a peak is not detected even by the peak detection process of step S106, program control returns through step S107. This declares that hand-swing motion currently applied to the hand controller 1 does not contribute to occurrence of a peak.

FIG. 15 shows another example of sensor output process. This example is designed to use both of outputs of the gyro sensors and acceleration sensors in an equal manner. In first step S111, the apparatus inputs outputs of the gyro sensors 2X, 2Y in X, Y directions. In addition, the apparatus inputs outputs of the acceleration sensors 24, 27 in X, Y direction in step S112. In step S113, the apparatus executes peak detection process based on detection values of the gyro sensors and acceleration sensors. If a peak is detected by the peak detection process of step S113, program control goes to step S115 through step S114, wherein the apparatus outputs a note-on event of a keycode corresponding to the detected peak. If a peak is not detected, program control returns through step S114. This declares that hand-swing motion currently applied to the hand controller 1 does not contribute to occurrence of a peak.

Next, a variety of modifications can be proposed for the automatic performance control apparatus within the scope of the invention, as follows:

The embodiment uses two gyro sensors for beat detection. However a number of the gyro sensors is not limited to two. Hence, it is possible to employ three or more gyro sensors for beat detection. For example, gyro sensors used for triple time can differ from gyro sensors used for duple time or quadruple time. Or, it is possible to perform beat detection by considering all of outputs of three or more gyro sensors collectively.

In the embodiment, the automatic performance control apparatus is provided independently of the electronic musical instrument having the automatic performance function. However, it is possible to put them together as one apparatus. Or, the embodiment can be re-designed such that MIDI clocks are outputted to an external device to perform tempo control.

The tempo control, employed by the invention, does not have a limited use for triple time only. For example, the invention can be applied to duple time or quadruple time. In this case, the hand controller is designed to have a capability of detecting hand-swing motions in up/down directions only. Herein, an odd-number beat corresponds to a downward hand-swing motion whilst an even-number beat corresponds to an upward hand-swing motion. So, the automatic performance control apparatus is designed to produce two kinds of beat-timing detection signals which respectively correspond to the upward and downward hand-swing motions. By the way, the embodiment performs tempo control by giving consideration to detection as to which of beats in triple time corresponds to hand-swing motion. However, it is possible to perform the tempo control without giving such a consideration; in other words, the tempo control can be performed by merely detecting a beat timing. The embodiment performs tempo control by each beat timing. However, the invention is not limited to such a tempo control executed in a limited timing. So, the tempo control can be performed by a certain timing which is smaller than or larger than the beat timing.

In the case of triple time, as described before, a first beat is determined by the beat-number determination process; a second beat is determined by the second-beat determination process; and a third beat is determined by the third-beat determination process. However, those processes can be modified. A locus in hand-swing motion of the conductor's baton can be divided into three kinds of motions, e.g., a downward motion, a horizontal motion and an upward motion. In the case of the triple time, those three kinds of motions respectively correspond to three sides of the equilateral triangle in the locus of the conductor's baton. In the case of duple time, only two kinds of motions, i.e., the upward motion and downward motion, are employed. Similarly, in the case of quadruple time, the two kinds of motions are repeated. So, the aforementioned three kinds of processes can be re-designed such that the beat-number determination process is converted to motion-1 determination process regarding the downward motion; the second-beat determination process is converted to motion-2 determination process regarding the horizontal motion; and the third-beat determination process is converted to motion-3 determination process regarding the upward motion. In that case, all of the three kinds of processes are employed for the triple time. However, both of the duple time and quadruple time employ only the motion-1 determination process and motion-3 determination process. In the case of the duple time, the motion-1 determination process is used to determine a first beat whilst the motion-3 determination process is used to determine a second beat. In the case of the quadruple time, the motion-1 determination process is used to determine first and third beats whilst the motion-3 determination process is used to determine second and fourth beats. Anyway, software processes used by the embodiment can be arbitrarily modified within the scope of the invention.

In order to detect hand-swing motion of the human operator, the embodiment uses the hand controller in which sensors are built in. Positions of the sensors are not limited to the inside area of the hand controller. In other words, the sensors can be built in a conductor's baton; the sensors can be attached to a body (or a hand or a leg) of the human operator; the sensors can be built in a microphone; or the sensors can be built in a remote-control device of some apparatus such as karaoke apparatus. In that case, detection values of the sensors can be transmitted to the main body of the automatic performance control apparatus by wireless communication or by wired communication.

The embodiment performs tempo control during progression of automatic performance in real time. Of course, the embodiment can be re-designed such that a tempo is designated prior to execution of the automatic performance.

The performance data, used by the embodiment, have a data form of "event plus delta time". Of course, it is possible to employ another data form such as a data form of "event plus absolute time". Incidentally, the delta time is measured based on a unit of milli-second. However, the delta time can be measured based on another unit such as a unit corresponding to a note length (e.g., 1/24 of quarter note).

The embodiment performs tempo control in such a manner that delta time is increased or decreased by being multiplied by a tempo coefficient. However, it is possible to alter a tempo by altering a period of process (e.g., clock frequency).

The electronic musical instrument stores beat-timing data as a part of automatic performance data (i.e., data of CHANNEL 1). However, it is possible to provide the beat-timing data independently of the automatic performance data.

It is possible to perform interpolation between a previous value of tempo and a current value of tempo, so that tempo can be smoothly varied. Similarly, dynamics can be controlled to be varied smoothly.

In the embodiment, tempo is controlled such that a position of a peak in sensor output (i.e., a position at which angular velocity become maximum) meets a beat position. In contrast, the tempo can be controlled to respond to a position of a bottom in sensor output (in other words, a position at which angular velocity becomes minimum; i.e., a position at which the hand controller almost stops). Or, the tempo can be controlled to respond to a certain position which is set between the peak and bottom of the angular velocity.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within meets and bounds of the claims, or equivalence of such meets and bounds are therefore intended to be embraced by the claims.

What is claimed is:

1. An automatic performance control apparatus comprising:

automatic performance means for sequentially reading out automatic performance data so as to carry out automatic performance;

a hand controller, which is swung and manipulated by a human operator, for designating beat timings;

angular velocity detecting means, which is built in the hand controller, for detecting angular velocity applied to the hand controller;

beat-timing detecting means for detecting the beat timings, designated by the human operator, based on detection values of the angular velocity detecting means; and tempo control means for controlling a tempo of the automatic performance based on result of detection made by the beat-timing detecting means.

2. An automatic performance control apparatus according to claim 1 further comprising:

swing-state detecting means for detecting an intensity of swinging of the hand controller based on the detection values of the angular velocity detecting means; and tone-volume control means for controlling tone volume of the automatic performance based on result of detection made by the swing-state detecting means.

3. An automatic performance control apparatus according to claim 1 or 2 wherein the angular velocity detecting means consists of a plurality of gyro sensors each corresponding to a different axis of rotation.

4. An automatic performance control apparatus according to claim 1 wherein the beat-timing detecting means contains beat-number detecting means for detecting a beat number representing which beat in a measure corresponds to a beat timing currently designated.

5. An automatic performance control apparatus according to claim 1 wherein the automatic performance data contain beat-timing data representing beat timings preset for the automatic performance; and the tempo control means performs comparison between the beat-timing data, which are read out by the automatic performance means, and the beat timings, which are designated by the beat-timing detecting means, so that the tempo control is performed on the automatic performance based on result of the comparison.

6. An automatic performance control apparatus according to claim 1 wherein the beat-timing detecting means is designed to determine a peak of the angular velocity, detected by the angular velocity detecting means, as a beat timing.

7. An automatic performance control apparatus according to claim 1 wherein the beat-timing detecting means is designed to determine a bottom of the angular velocity, detected by the angular velocity detecting means, as a beat timing.

8. An automatic performance control apparatus according to claim 1 wherein the beat-timing detecting means is designed to determine a discontinuous change point In a swing direction of the hand controller, detected by the angular velocity detecting means as a beat timing.

9. An automatic performance control apparatus according to claim 1 wherein the beat-timing detecting means supplies control data to the automatic performance means in a form of note-on data of a specific MIDI channel.

10. An automatic performance control apparatus according to claim 1 further comprising acceleration sensor means which is attached to the hand controller, wherein the beat-timing detecting means detects beat timings based on the detection values of the angular velocity detecting means as well as detection values of the acceleration sensor means.

11. An automatic performance control apparatus according to claim 1 further comprising acceleration sensor means which is attached to the hand controller, wherein the beat-timing detecting means firstly uses the detection values of the angular velocity detecting means for detection of the beat timings, while if the beat-timing detecting means fails to do so, the beat-timing detecting means uses detection values of the acceleration sensor means for detection of the beat timings.

12. An automatic performance control apparatus according to claim 4 wherein the hand controller is swung in a different direction by each beat number; and the beat-timing detecting means is designed to make a decision for a beat number, currently designated, by using an angular range to which a swing direction of the hand controller belongs.

13. An automatic performance control apparatus according to claim 4 wherein the hand controller is swung in a different direction by each beat number; and the beat-number detecting means is designed to make a decision for a beat number, currently designated, by using an angle difference between a previous swing direction, which is applied to the hand controller for previous designation of beat, and a current swing direction which is applied to the hand controller for current designation of beat.

14. An automatic performance control apparatus according to one of claims 4, 12 and 13 wherein the beat-timing detecting means is designed to detect a beat number, currently designated, under consideration of a previous beat number corresponding to previous designation of beat.

15. An automatic performance control apparatus according to claim 5 wherein the beat-timing data of the automatic performance data contain beat-number data representing a beat number which corresponds to one of beats in a measure; and the tempo control means performs comparison between the beat-number data, which are read out by the automatic performance means, and beat numbers, which are detected by the beat-timing detecting means, so that the tempo control is performed on the automatic performance based on result of the comparison.

16. An automatic performance control apparatus comprising:

automatic performance means for sequentially reading out automatic performance data so as to carry out automatic performance;

a hand controller, in which a plurality of swing detection means are built, for designating beat timings by being swung and manipulated by a human operator;

beat detection means for detecting a beat number based on output of the plurality of swing detection means, wherein the beat number represents which beat corresponds to a beat timing designated by the human operator; and tempo control means for controlling a tempo of the automatic performance based on result of detection made by the beat detection means.

17. An automatic performance control apparatus according to claim 16 wherein the beat detection means, containing determination means, is designed to determine a peak timing, corresponding to a peak in output of the plurality of swing detection means, as a beat timing; and the determination means determines a current peak timing, which occurs under a condition where a certain time or more is passed after a previous beat timing, as a current beat timing.

18. An automatic performance control apparatus according to claim 16 wherein the beat detection means, containing determination means, is designed to determine a peak timing, corresponding to a peak in output of the plurality of swing detection means, as a beat timing; and the determination means determines a current peak timing, whose peak value is a certain number of times larger than a peak value of a previous beat timing, as a current beat timing.

19. An automatic performance control apparatus according to claim 16 wherein the beat detection means, containing determination means, determines a peak timing, corresponding to a peak in output of the plurality of swing detection means, as a beat timing; and the determination means determines a current peak timing, which occurs under a condition where the output becomes lower than a threshold value after occurrence of a previous peak timing, as a current beat timing.

20. An automatic performance control apparatus according to claim 16 wherein the beat detection means contains direction detecting means which detects a swing direction of the hand controller based on output of the plurality of swing detection means, so that a beat number is detected responsive to an angle in the swing direction detected by the direction detecting means.

21. An automatic performance control apparatus according to claim 16 wherein the beat detection means contains direction detecting means which detects a swing direction of the hand controller based on output of the plurality of swing detection means, so that a current beat number is detected in response to difference between a previous angle in a previous swing direction and a current angle in a current swing direction.

22. An automatic performance control apparatus according to claim 16 wherein the beat detection means contains direction detecting means which detects a swing direction of the hand controller based on output of the plurality of swing detection means so that a beat number is detected responsive to an angle in a swing direction detected by the direction detection means, whereby a current beat number is determined responsive to a previous beat number.

23. An automatic performance control apparatus according to claim 16 wherein the hand controller uses an angular velocity sensor to detect a swing motion thereof.

24. An automatic performance control apparatus according to claim 16 wherein the hand controller uses an acceleration sensor to detect a swing motion thereof.

25. An automatic performance control apparatus according to claim 16 wherein the hand controller uses an angular velocity sensor and an acceleration sensor to detect a swing motion thereof.

26. An automatic performance control apparatus which is connected to an electronic musical instrument having an automatic performance function through data communication based on MIDI standard, the automatic performance control apparatus comprising:

a hand controller, containing two gyro sensors, which is swung and manipulated by a hand of a human operator, wherein the two gyro sensors are arranged to detect angular velocity in X and Y directions in a locus of hand-swing motion of the hand controller, so that the hand controller outputs angular velocity data;

beat detection means for detecting a beat timing based on a peak of angular velocity and/or a bottom of angular velocity on the basis of the angular velocity data;

beat-number determination means for determining a beat number, representing which of beats in a measure corresponds to a beat timing currently designated, on the basis of a beat number of a previous beat timing; and means for creating beat-timing detection data based on the beat timing and the beat number, the beat-timing detection data being transmitted to the electronic musical instrument in a data form of MIDI standard, whereby tempo control based on the beat-timing detection data is performed on automatic performance played by the electronic musical instrument.

27. An automatic performance control apparatus according to claim 26 further comprising two acceleration sensors which are attached to the hand controller and which are arranged in the X and Y directions in the locus of hand-swing motion of the hand controller so as to assist detection of the beat timing.

28. An electronic musical instrument comprising:

automatic performance means for playing automatic performance based on automatic performance data;

a hand controller, containing two gyro sensors, which is swung and manipulated by a hand of a human operator, wherein the two gyro sensors are arranged to detect angular velocity in X and Y directions in a locus of hand-swing motion of the hand controller, so that the hand controller outputs angular velocity data;

beat detection means for detecting a beat timing based on a peak of angular velocity and/or a bottom of angular velocity on the basis of the angular velocity data;

beat-number determination means for determining a beat number, representing which of beats in a measure corresponds to a beat timing currently designated, on the basis of a beat number of a previous beat timing;

means for creating beat-timing detection data based on the beat timing and the beat number; and tempo control means for controlling a tempo of the automatic performance in response to the beat-timing detection data in real time.

29. An electronic musical instrument according to claim 28 further comprising two acceleration sensors which are attached to the hand controller and which are arranged in the X and Y directions in the locus of hand-swing motion of the hand controller so as to assist detection of the beat timing.

30. A method of controlling automatic performance, comprising the steps of:

detecting angular velocity applied to an object which is swung by a human operator like a conductor's baton;

detecting a beat timing, which is designated by swing motion of the object swung by the human operator, based on a manner of variation of the angular velocity; and controlling a tempo of the automatic performance in response to the beat timing.

31. A method of controlling automatic performance according to claim 30, wherein the beat timing is detected based on at least a peak of the angular velocity.

32. A method of controlling automatic performance according to claim 30, wherein the beat timing is detected based on a peak of the angular velocity in connection with a bottom of the angular velocity.

33. A method of controlling automatic performance, comprising the steps of:

detecting angular velocity applied to an object which is swung by a human operator like a conductor's baton;

detecting a peak of the angular velocity;

determining a beat timing based on the peak of the angular velocity;

detecting an angle of a swing direction of the object;

determining a beat number, representing which of beats in a measure corresponds to a beat timing currently detected, on the basis of the angle of the swing direction of the object, wherein a current beat number is determined responsive to a previous beat number; and controlling a tempo of the automatic performance in response to the beat timing and the beat number.

34. A method of controlling a tempo of automatic performance in response to a swing motion of an object which is swung by a human operator like a conductor's baton, comprising the steps of:

setting time of a tune which is subjected to automatic performance;

detecting angular velocity of the object which varies responsive to the swing motion of the object;

performing analysis on a locus of the swing motion of the object on the basis of a manner of variation of the angular velocity;

determining a peak timing, corresponding to a peak of the angular velocity, as a beat timing, which is designated by the human operator who swings the object, on the basis of result of the analysis; and controlling the tempo of the automatic performance in response to the beat timing.

35. A method according to claim 34, wherein if the tune has triple time, the locus of the swing motion of the object corresponds to an equilateral triangle, so that the peak appears three times in one measure.

* * * * *